US011725452B2

(12) United States Patent
Van Santen

(10) Patent No.: US 11,725,452 B2
(45) Date of Patent: Aug. 15, 2023

(54) INDOOR VENTILATION SYSTEM

(71) Applicant: UBLO INC., Seoul (KR)

(72) Inventor: Robert-Jan Van Santen, Kowloon (HK)

(73) Assignee: UBLO INC., Seoul (KR)

( * ) Notice: Subject to any disclaimer, the term of this patent is extended or adjusted under 35 U.S.C. 154(b) by 232 days.

(21) Appl. No.: 16/961,169

(22) PCT Filed: Jan. 10, 2019

(86) PCT No.: PCT/KR2019/000400
§ 371 (c)(1),
(2) Date: Jul. 9, 2020

(87) PCT Pub. No.: WO2019/139379
PCT Pub. Date: Jul. 18, 2019

(65) Prior Publication Data

US 2021/0054685 A1 Feb. 25, 2021

(30) Foreign Application Priority Data

Jan. 11, 2018 (KR) ..... KR10-2018-0003746
Jan. 9, 2019 (KR) ..... KR10-2019-0002721
(Continued)

(51) Int. Cl.
*E06B 7/02* (2006.01)
*F24F 13/18* (2006.01)
*F24F 7/003* (2021.01)

(52) U.S. Cl.
CPC ..... *E06B 7/02* (2013.01); *F24F 13/18* (2013.01); *F24F 7/003* (2021.01); *F24F 2221/20* (2013.01)

(58) Field of Classification Search
CPC ..... F24F 2007/0025; F24F 2221/44; F24F 13/18; E06B 7/02
(Continued)

(56) References Cited

U.S. PATENT DOCUMENTS 1,544,209 A * 6/1925 Bernhardt ..... E06B 7/02 49/39
1,650,586 A * 11/1927 Andrews ..... B60H 1/3407 454/150
(Continued)

FOREIGN PATENT DOCUMENTS

CN 206377800 U 8/2017
CN 206377800 U * 8/2017
(Continued)

*Primary Examiner* — Edelmira Bosques
*Assistant Examiner* — Frances F. Hamilton
(74) *Attorney, Agent, or Firm* — Bridgeway IP Law Group, PLLC; Sang Ho Lee; Hyun Woo Shin

(57) ABSTRACT

A system for selectively opening and closing a ventilation opening in a window glass panel. The system includes a shield gasket and a ring-shaped fixing frame inserted into the opening, with the gasket interposed between the opening and the fixing frame. A cover is inserted into the fixing frame to open and close the ventilation opening. Fixing frame alternatives include wherein the fixing frame comprises a drain structure, an exterior gutter, a filter, and peripheral elastic support hooks. Shield gasket alternatives include wherein a body part transforms into a cylindrical shape during installation of the fixing frame, and wherein a wall part comprises a circumferential elastic protruding part forming an inner space part therein. Cover alternatives include wherein the cover includes ring shaped shielding walls and a hook to engage fixing frame insertion groove.

17 Claims, 19 Drawing Sheets

(30) Foreign Application Priority Data

Jan. 9, 2019 (KR) ..... KR10-2019-0002734
Jan. 9, 2019 (KR) ..... KR10-2019-0002740
Jan. 9, 2019 (KR) ..... KR10-2019-0002742
Jan. 9, 2019 (KR) ..... KR10-2019-0002751

(58) Field of Classification Search
USPC ..... 454/212, 81, 95, 96, 107, 111, 340, 184, 454/195
See application file for complete search history.

(56) References Cited

U.S. PATENT DOCUMENTS 1,870,720 A * 8/1932 Farley ..... E06B 7/06 454/212
2,134,937 A * 11/1938 Goldberg ..... E06B 7/30 454/212
2,644,609 A * 7/1953 Foss ..... F16K 24/04 454/275
4,441,404 A * 4/1984 Simon ..... E06B 7/02 454/212
4,970,946 A * 11/1990 Ivey ..... B63J 2/04 114/211
5,376,044 A * 12/1994 Tippin ..... F24F 13/18 251/303
5,797,791 A * 8/1998 Humphrey ..... B60J 1/08 454/94
6,585,582 B1 * 7/2003 Ziegler ..... F24F 13/084 454/118
7,637,063 B2 * 12/2009 Sensini ..... E06B 7/02 52/302.1
9,730,360 B2 * 8/2017 Manahan ..... H02B 1/28
10,117,347 B2 * 10/2018 Zaiki ..... H05K 5/0213
2005/0076588 A1 * 4/2005 Sensini ..... E06B 7/02 52/204.6
2008/0041624 A1 * 2/2008 Sasaki ..... H05K 5/0213 174/520
2009/0211512 A1 * 8/2009 Mason ..... B63B 19/14 114/361
2015/0159428 A1 * 6/2015 Johnson ..... E06B 7/14 49/471

FOREIGN PATENT DOCUMENTS

CN 107165556 A * 9/2017
CN 107415649 A * 12/2017 ..... B60H 3/06
CN 109184519 A * 1/2019 ..... E06B 7/02
DE 202017103341 U1 * 9/2017
DK 172353 B1 * 6/1995
EP 3444424 B1 * 11/2020 ..... E06B 7/02
GB 2220219 A * 1/1990 ..... E06B 1/003
JP 58-041435 U 3/1983
JP 2000-129903 A 5/2000
JP 2000129903 A * 5/2000
JP 2006-349335 A 12/2006
JP 2007-309557 A 11/2007
JP 2007309557 A * 11/2007
JP 2017101793 A * 6/2017
KR 100609015 B1 * 6/2005
KR 10-0609015 B1 8/2006
KR 10-2018-0128185 A 12/2018
KR 2018128185 A * 12/2018 ..... E06B 7/02
KR 102144731 B1 * 5/2020
WO WO-02093084 A1 * 11/2002 ..... E06B 7/02
WO WO-2015088783 A1 * 6/2015 ..... F24F 13/02
WO WO-2015133617 A1 * 9/2015 ..... H01G 11/14

* cited by examiner

INDOOR VENTILATION SYSTEM

TECHNICAL FIELD

The present invention relates to an indoor ventilation system, and more particularly, to an indoor ventilation system which can ventilate indoor air even without opening a glass window.

BACKGROUND ART

Windows are important parts of a building. Windows function to promote natural lighting and natural ventilation, and require a good appearance, watertightness, sound absorption, and protection performance.

In general, windows are opened and closed in a sliding type and in a hinged type. The sliding type window is configured in such a way that a dual rail is formed on a window frame and a plurality of windows are alternately combined with the dual rail. Moreover, a mothproofing window is mounted outside the window which is openable.

The hinged type window has a window frame divided into several areas. In the area which does not need opening and closing, a window pane is directly fixed on the window frame, and the hinged type window is mounted in any one among the areas.

FIG. 1 is a schematic view of a conventional window.

Referring to FIG. 1, the conventional window includes a rectangular window frame 2, and a pair of windows 4 sliding along rails formed at an upper portion and a lower portion of the window frame 2. Each of the window 4 includes a window sash 4*a* and a window pane 4*b* mounted on the window sash 4*a*. When a user moves the window 4 in order to ventilate air, one side of the window frame 2 is opened, and outdoor air enters through the opened space.

Such a conventional window includes the window sash 4*a* and the frame 2 to support the window pane 4*b*. However, the longer the window sash 4*a* and the frame 2, the lower insulation, airtightness and watertightness. If the opened space is too large to perform the role as a handrail, it may threaten the security against outside invasion and a falling accident.

Furthermore, the window sash 4*a* and the window frame 2 may visually obstruct outside views.

Such an openable window must have the window frame and the window sashes with dual structures, and the window frame must have not only a window opening and closing structure but also a heat insulation structure, a waterproof structure and a soundproof structure when being combined with the window sashes. Therefore, the openable window is more expensive than unopenable windows.

Additionally, in case of the openable window, polluted outdoor air may enter into a room since the room area is opened as it is. Therefore, people are afraid of opening the window.

Ventilation is desperately required in a building, but we cannot open the window on severely polluted days. It may damage people's health due to an increase of the pollution level in indoor air.

In addition, people frequently clean the interior of the room with the window shut since being afraid of opening the window, and it increases the pollution level in indoor air.

DISCLOSURE

Technical Problem

Accordingly, the present invention has been made in an effort to solve the above-mentioned problems occurring in the prior arts, and it is an object of the present invention to provide an indoor ventilation system which can ventilate indoor air without installing openable windows which have been used traditionally.

It is another object of the present invention to provide an indoor ventilation system which is high in safety coefficient since preventing a fall of a child or a fall of things through the window.

It is a further object of the present invention to provide an indoor ventilation system which can provide a beautiful design by adding decorative ornaments or various functions on the window.

Technical Solution

To achieve the above objects, the present invention provides an indoor ventilation system including: an opening part formed in a window glass; and an opening and closing means for blocking or opening the opening part.

The opening and closing means may be a lid or a cover inserted into the opening part to block the opening part or picked out to open the opening part.

Alternatively, a door-type cover is hinge-coupled to a lateral side of the opening part to open and close the opening part.

A fixing frame is mounted at the opening part, and an operation part, a side door or a sliding operation part which is inserted into or drawn out of the fixing frame may be added in various ways.

The window glass may have one or more opening parts. The window glass may have one glass pane. Alternatively, the window glass may be multiple glazing units having a plurality of glass panes. In case that the opening parts are formed in the window glass panes, a space between the glass panes of the opening parts is sealed, and a spacer is inserted into the opening part.

The opening and closing means includes a ring-shaped fixing frame mounted at the opening part, a cap-type operation part inserted into the fixing frame, and a cover part attached to the operation part.

Moreover, an air filter or a foreign matter filter may be mounted inside the fixing frame. The cover part may be designed in various forms to provide an esthetic sense.

Furthermore, the cover part may be formed in a storage box shape, an electronic clock, a small-sized flowerpot, a small-sized aquarium, a lamp, a speaker, or others.

Advantageous Effects

The indoor ventilation system according to the present invention can reduce window installation costs since not needing the conventional window sash and the conventional window frame for supporting and moving the glass panel.

Moreover, the indoor ventilation system according to the present invention can enhance sound insulation and thermal insulation effects since the fixing frame is sealed to the glass panel.

Furthermore, because the size of the opening part formed in the glass panel is still smaller than an open area of the conventional glass window, the indoor ventilation system can prevent invasion of an invader and prevent a child from falling down.

Additionally, the indoor ventilation system according to the present invention can ventilate indoor air without the conventional openable window since only the opening part is opened outwards.

In addition, the cover part may be customized individually to greatly make better use of a space and improve beauty of the window body.

MODES FOR INVENTION

Figure 1:
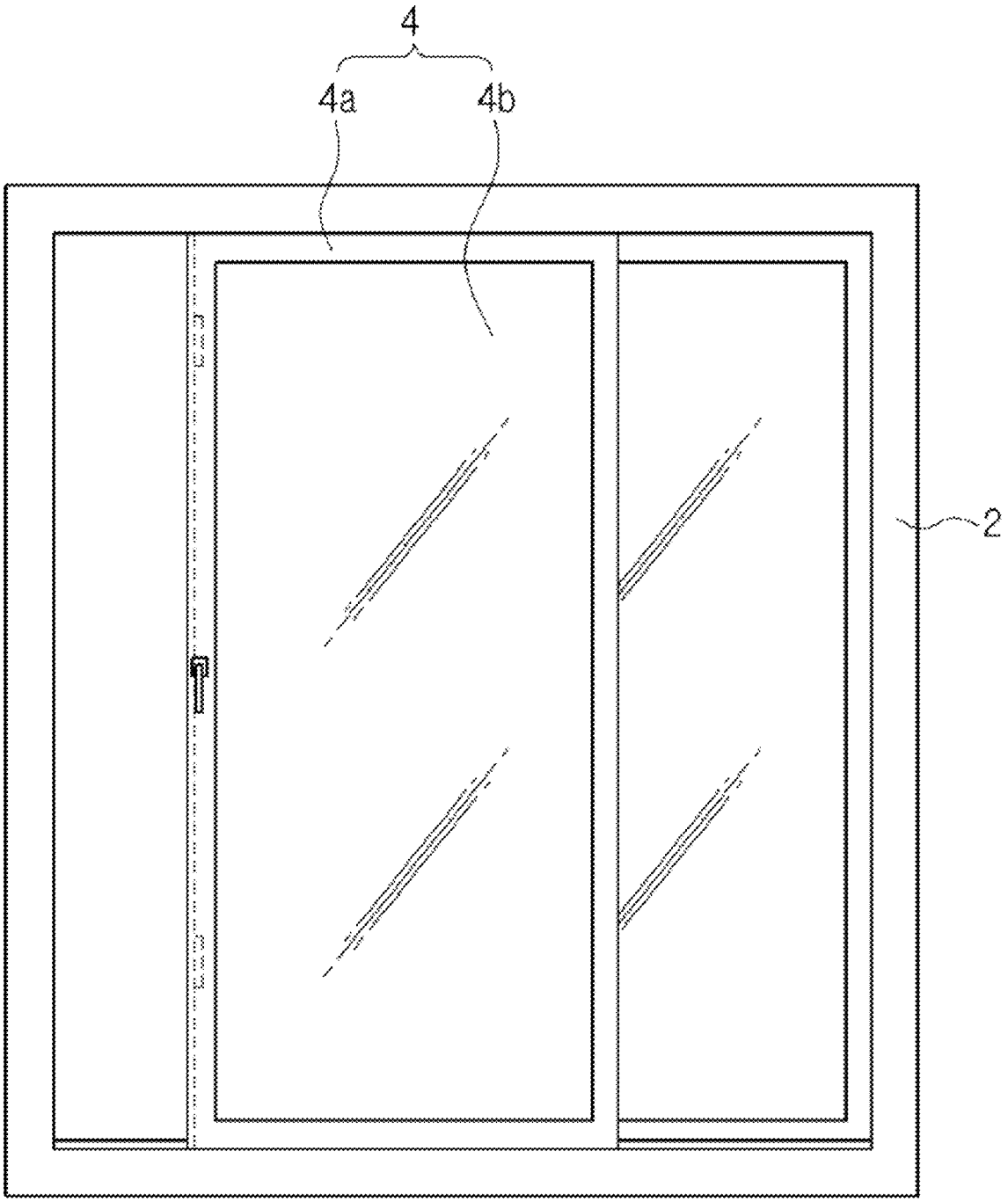
PRIOR ART FIG. 1
FIG. 1 is a schematic view of a conventional window.

In order to achieve the above objects, an indoor ventilation system according to the present invention includes an opening part formed in a window glass; and an opening and closing means for opening and closing the opening part.

The opening and closing means includes a lid-type cover in order to block or open the opening part.

One or more opening parts are formed to be spaced apart from each other, and the opening and closing means are respectively mounted in order to respectively open and close the opening parts.

In a preferred embodiment of the present invention, the indoor ventilation system further includes a ring-shaped fixing frame mounted on the opening part and an operation part for opening and closing the fixing frame.

The operation part is inserted and fixed into the fixing frame to be removable. For an example, the fixing frame and the operation part respectively have screw threads corresponding to each other so that they are screw-coupled with each other. For another example, the operation part is pushed into the fixing frame to be mounted and is pulled out.

The fixing frame has a cylindrical structure having an outer flange formed on the indoor side thereof. The fixing frame is inserted into the opening part to protrude outwards, and a space between the inner circumference of the opening part and the fixing frame is sealed.

A first shield gasket is interposed between the fixing frame and the inner circumference of the opening part to be sealed.

The first shield gasket may be a shield gasket previously molded in a round shape or may be a shield gasket that silicone sealant is injected and hardened. The first shield gasket may be formed in an all-in-one type or may be formed in a split type.

The window glass may be in a single glass pane form like a tempered glass pane, or may be a double glass window or a triple glass window that a plurality of glass panes are arranged at an interval.

In case of the double glass window or the triple glass window, a spacer is interposed between the glass panes, and a space between the glass panes is sealed. The shield gasket is fit on the spacer, or silicone sealant is injected between the glass panes to seal and the spacer is inserted. The spacer has a ring-shaped structure which can keep an interval between the glass panes.

A gutter part is formed at the end of inner surface of the cylindrical part of the fixing frame, and a round filter of a partition type is seated on the gutter part. The filter may be a mesh filter for simply blocking inflow of foreign matters or insects or may be a dust filter for blocking fine dust. The filter includes a flexible filter frame, for instance, a rubber frame or a silicone sealant frame, and a flexible filter mounted on the filter frame, and is configured to be easily inserted into the fixing frame or to be replaceable.

The fixing frame includes a cylindrical part formed to be perforated, and an outer flange protruding from the indoor side of the cylindrical part toward the outer circumferential surface. The rim of the cylindrical part is inserted to protrude towards outdoor side, and has a first gutter formed on the outer circumferential surface. The first gutter has a structure that rainwater collects and drops down. A second gutter is formed on the outer flange. A second shield gasket is inserted into the second gutter. The second shield gasket seals a space between the fixing frame and the operation part.

The operation part includes a cylindrical part inserted into the fixing frame, and the cylindrical part has a blocked bottom surface. A flange is formed on the outer circumference of the indoor side rim of the cylindrical part.

The fixing frame has a structure for inserting and fixing the operation part. Screw threads are respectively formed on the inner circumferential surface of the fixing frame and the outer circumference of the operation part so that the fixing frame and the operation part are screw-coupled with each other. Alternatively, one of the fixing frame and the operation part has a guide protrusion and the other one has a guide groove having a bent end to correspond to the guide protrusion so that the guide protrusion is inserted and pushed into the guide groove and is caught to the bent end by rotation of the operation part.

In this embodiment, the operation part is inserted into the fixing frame, and then, a coupled part is caught and fixed.

The fixing frame includes an inner flange protruding from the inner rim of the indoor side of the fixing frame, and a plurality of insertion grooves formed in the inner flange. The operation part includes hook-shaped coupling parts corresponding to the insertion grooves. The coupling parts are inserted into the insertion grooves, and is inserted and fixed to the inner flange by rotation of the operation part. The present invention is not limited to the above, and may have various coupling structures that the operation part is inserted and fixed into the fixing frame.

If the operation is inserted and mounted into the fixing frame, a sealing structure is needed. When the second shield gasket is inserted into the second gutter of the fixing frame and the operation part is inserted into the fixing frame, the flange of the operation part presses the second shield gasket to be sealed to the second shield gasket so that the space between the fixing frame and the operation part is sealed. The second shield gasket may be a round packing member or may be any one among various forms.

The fixing frame protrudes towards outdoor side, and rainwater may be introduced through an opening portion of the cylindrical part. The filter is mounted in the cylindrical part, but rainwater may be introduced through the filter. Therefore, a structure for draining the rainwater flowing in is required.

The indoor ventilation system according to the present invention has a rainwater drain structure for draining rainwater flowing between the fixing frame and the operation part. The fixing frame has a plurality of shielding walls protruding on the inner circumferential surface in a round shape. The operation part also has a plurality of shielding walls protruding on the outer circumferential surface in a round shape corresponding to the shielding walls of the fixing frame. The operation part further has a plurality of guiders which connect the shielding walls in a perpendicular to the longitudinal direction of the shielding walls. The guiders prevent the shielding walls from interfering with each other when the operation part is inserted into the fixing frame.

The inner circumferential wall of the fixing frame is high in the indoor side and is low in the outdoor side so as to form an inclined surface. The shielding wall of the fixing frame has a groove that raindrops run down and a drain hole for discharging the raindrops guided through the groove to the outside. Therefore, the rainwater is introduced through the filter passes between the shielding walls, is guided into the drain hole through the groove, and then, is discharged to the outside through the drain hole.

The operation part closes the fixing frame by being inserted into the fixing frame in order to close the window, and then, is removed from the fixing frame to open the window. The operation part further includes a holding structure to hold the operation part when the operation part is removed. A hook is disposed at or near the edge of the bottom surface of the cylindrical part of the operation part. The hook is caught to the inner flange of the fixing frame. Alternatively, the hook may be inserted into the insertion groove formed in the inner flange of the fixing frame. Therefore, the operation part is drawn out and is hung on the indoor side rim of the fixing frame.

The operation part may be formed in a cap type. The operation part further includes a cover part. The cover part may have one of various designs. The cover part may be fastened on the flange of the operation part by a fastening screw or may be detachably fastened by screw coupling. The cover part has a hand-grip part so that a user can use the hand-grip part to push in and pull out the operation part.

Moreover, the operation part may be used as a storage box without the cover part, and the cover part is configured for one of a small-sized water tank, an electronic clock, a lamp, a flowerpot plant, a wireless speaker, a piggy-bank, and a mirror-mounted storage box.

In the meantime, in another embodiment of the present invention, a first shield gas is formed by structural silicone sealant. In this instance, it is difficult to separate the fixing frame. So, there is a structure of the first shield gasket and a structure of the fixing frame to easily separate the fixing frame to repair the fixing frame which breaks down.

The indoor ventilation system according to present invention includes: an opening part formed in a window glass; a ring-shaped fixing frame inserted into the opening part to protrude outwards; an operation part for blocking or opening the fixing frame; and a first shield gasket interposed between the opening part and the fixing frame.

The first shield gasket is formed in a doughnut shape, and includes: a through hole part formed at the center; a body part extending from the through hole part to have a predetermined width corresponding to the thickness of the opening part; and an adhesive surface extending from the body part.

When the adhesive part is adhered on the glass panel around the opening part and the fixing frame is forcibly inserted into the opening part, the body part is transformed into a cylindrical shape and is interposed between the inner circumference of the opening part and the outer circumference of the fixing frame to seal a space between the opening part and the fixing frame.

The indoor ventilation system further includes a plurality of clamping means mounted on the cylindrical part protruding to the outdoor side of the fixing frame to elastically support the outdoor side glass panel of the opening part.

The clamping means includes: a plurality of hook holes formed in the cylindrical part protruding to the outdoor side of the fixing frame; a head part caught to a lower portion of the hook hole; a hook part connected from the head part to pass through the hook hole; and a pivoting hook attached to the end of the hook part and having a packing for elastically supporting the outdoor side glass panel of the opening part.

Additionally, in order to seal a space between the fixing frame and the operation part, a second shield gasket is inserted and mounted between the fixing frame and the operation part. A second gutter for inserting a shield gasket is formed on the outer flange of the fixing frame, and the second shield gasket is inserted and mounted into the second gutter to seal the space between the fixing frame and the operation part.

The second shield gasket includes a body part inserted into the second gutter and a wing part protruding outwards from the body part to be inclined.

The second shield gasket further includes a plurality of protrusions formed around the body part and is compressed to the side wall of the second gutter to be inserted.

In order to combine the operation part with the fixing frame and compress the second shield gasket, a coupling means for coupling and fixing the operation part to the fixing frame is required.

The fixing frame further includes an inner flange corresponding to the outer flange and a plurality of insertion grooves formed in the inner flange, and the operation part includes a plurality of combining parts formed on the outer circumferential surface of the cylindrical part of the operation part to pass through the insertion grooves and to be caught to the inner flange by rotation of the operation part. When the operation part is inserted into the fixing frame and is rotated to fix the combining part, the flange of the operation part is sealed to the second shield gasket by pressing the second shield gasket so as to seal the space between the fixing frame and the operation part.

In addition, the fixing frame may be divided into an indoor side fixing frame and an outdoor side fixing frame, and the outer fixing frame becomes an exterior cover shield gasket. The inner fixing frame and the exterior cover shield gasket are combined with each other.

The indoor ventilation system according to the present invention includes a shield gasket combined with the fixing frame and interposed between the fixing frame and the opening, and the exterior cover shield gasket for covering the outside of the opening part.

The exterior cover shield gasket includes: a through hole formed in the middle thereof; a rim cover part extending from the inner circumference of the through hole to cover the rim portion of the fixing frame; a cylindrical shield gasket part protruding from the outer face of the rim cover part and interposed between the outer circumference of indoor side of the fixing frame and the inner circumference of the opening part to seal; and an exterior cover part extending from the rim cover part to cover a part of the outdoor side glass panel of the opening part.

The shield gasket part includes a first elastic part protruding from the outer circumference thereof and having an inner space part, and the first elastic part is compressed between the outdoor side glass surface of the opening part and the fixing frame to seal.

The exterior cover part is pressed to the glass panel around the opening part with elasticity, and includes a second elastic part, which is formed at the rim of the exterior cover part, has an inner space part, and is pressed to the glass panel around the opening part by elasticity of the exterior cover part.

Therefore, the exterior cover shield gasket serves as the shield gasket and an exterior cover between the opening part and the fixing frame. The fixing frame can be easily detached from the indoor side.

In the meantime, the window glass may have double or triple glass panes in order to enhance thermal insulation function. Also, the window glass having the double or triple glass panes has the opening part. A spacer is disposed in the opening part between the glass panes.

The spacer may be formed integrally with the fixing frame inserted into the opening part in order to maintain an interval between the glass panes.

The window glass has multiple glass panes, and the spacer is disposed integrally with the fixing frame mounted in the opening part to maintain the interval between the glass panes.

The spacer formed integrally with the fixing frame has a third shield ring inserted into the spacer to seal a space between the glass panes, and the spacer is sealed to the third shield ring in order to seal the space between the glass panes and maintain the interval between the glass panes.

A sealing material is adhered between the outer flange of the fixing frame and the indoor side glass panel of the opening part in order to fix the fixing frame. First and second shield rings are interposed between the inner circumference of the opening part and the outer circumference of the cylindrical part, and the third shield ring is interposed between the glass panes outside the spacer in order to seal the space between the glass panes.

The first to third shield rings may be formed by silicone sealant injected between the glass panes and between the inner circumference of the opening part and the outer circumference of the fixing frame.

Hereinafter, the present invention will be described in more detail with reference to preferred embodiments. Here, it will be understood that the particular embodiments described in the present invention are used to describe the disclosure of the present invention and there is no intent to limit the present invention.

In the drawings, parts having similar functions and actions have the same reference numerals but are not limited to the same shape. Moreover, the steps of the present invention are not used to limit the sequence, and the relative sequence of the steps may be adjusted as long as the sequence of the steps is not specified clearly or execution of the steps does not basically require additional steps. The inside and the outside described in the present invention mean the indoor side and the outdoor side.

Hereinafter, with reference to the attached drawings, preferred embodiments of an indoor ventilation system according to the present invention will be described in detail.

Figure 2:
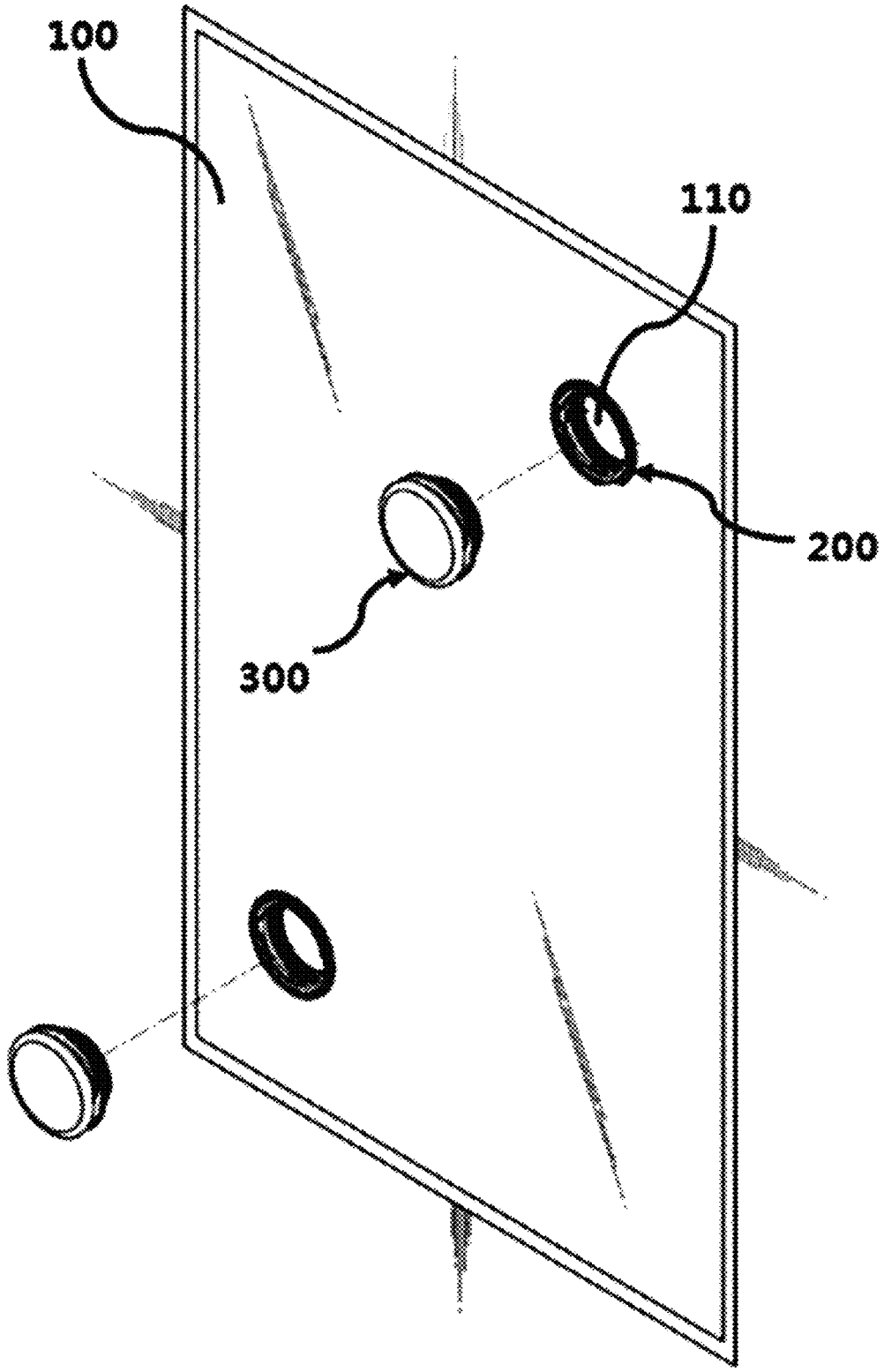
FIG. 2 is a view schematically illustrating an indoor ventilation system according to a preferred embodiment of the present invention.

FIG. 2 is a view schematically illustrating an indoor ventilation system according to a preferred embodiment of the present invention.

Referring to FIG. 2, the indoor ventilation system according to the preferred embodiment of the present invention includes an opening part 110 made in a window glass 100 and a ventilation window for opening and closing the opening part 110. In case of the indoor ventilation system having the opening part and the ventilation window, one indoor ventilation system may be mounted on one window or a plurality of the indoor ventilation systems may be mounted on one window. When the opening part is formed, locations, the number, sizes and shapes of the opening parts must be designed in consideration of the safety coefficient of glass. In connection with the shape, the opening part, preferably, does not have any edge like a circle or an oval.

The ventilation window may be formed in a plug type which is inserted into or pulled out of the opening part 110. Moreover, the ventilation window may have a structure that a fixing frame is inserted and fixed into the opening part 110 and an operation part or a door of a lid type, a slide type or a rotation type is mounted on the fixing frame to open or close the opening part 110.

The ventilation window may be a single part or may have a plurality of parts. If the ventilation window is a single part, a shield gasket seals the inner circumference of the opening part 110, and a lid which is a single part is inserted into the shield gasket to be close to the shield gasket or pulled out of the shield gasket. The lid is inserted into or pulled out of the shield gasket to open or close the window.

However, a tightly inserted structure between the lid and the shield gasket in consideration of sealability may damage the shield gasket, and a loosely inserted structure may deteriorate sealability.

Therefore, the preferred embodiment of the present invention proposes a ventilation window structure having a plurality of parts.

Figure 3:
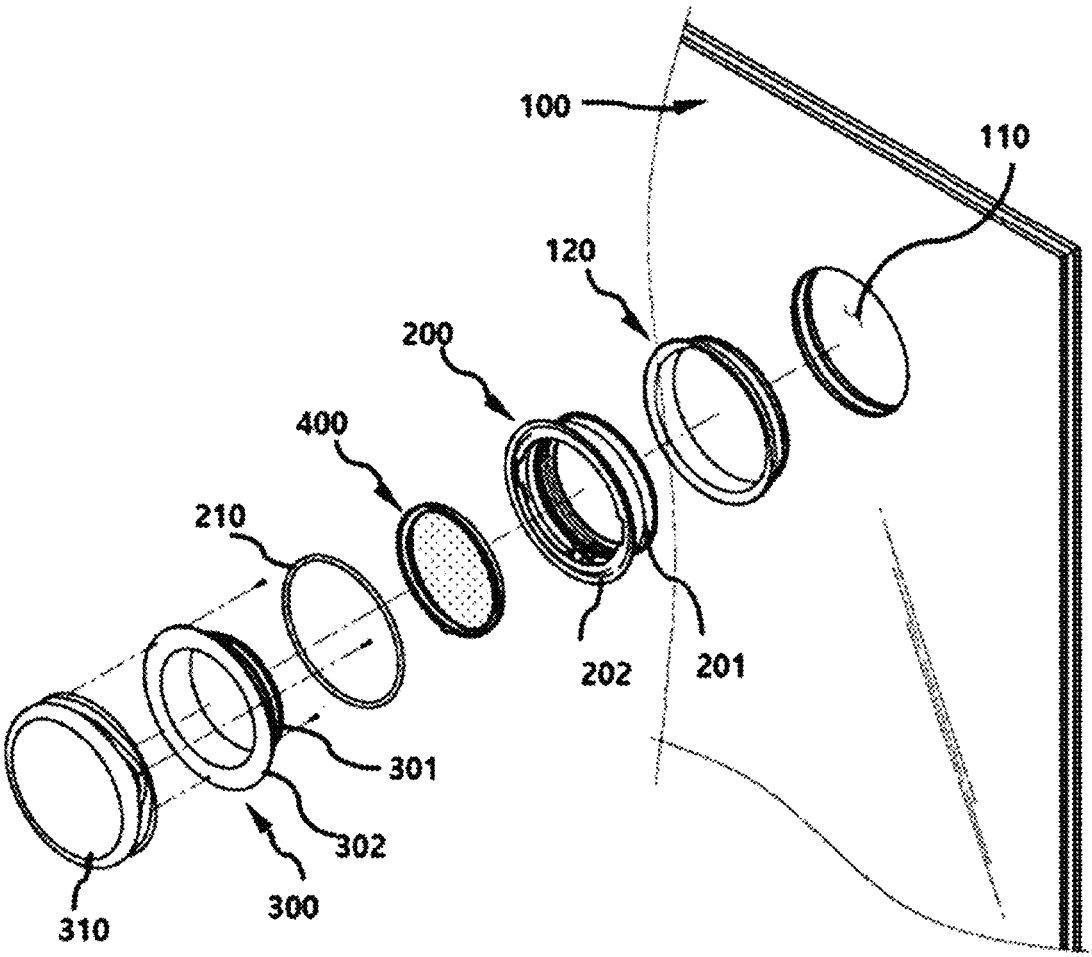
FIG. 3 is an exploded view schematically illustrating a structure of the indoor ventilation system according to the preferred embodiment of the present invention.

FIG. 3 is an exploded view schematically illustrating a structure of the indoor ventilation system according to the preferred embodiment of the present invention. As shown in FIG. 3, the indoor ventilation system according to the preferred embodiment of the present invention includes: the opening part 110 formed in the window glass 100; the fixing frame 200 sealably fixed on the inner circumferential surface of the opening part 110 and formed to be perforated; and an operation part 300 combined with the fixing frame 200 to open or close the opening part. A first shield gasket 120 is inserted between the opening part 110 and the fixing frame 200 to be sealed. An air filter 400 may be inserted and mounted at an inner rim of outdoor side of the fixing frame 200. A second shield gasket 210 is inserted and mounted between the fixing frame 200 and the operation part 300. A cover 310 is further combined with the indoor side of the operation part 300.

The operation part 300 is a part which has a closed cross section to open or block a hole formed in the fixing frame 200. For an example, the operation part 300 may be a member which can be inserted into or pulled out of the fixing frame 200 and has a closed bottom surface. For another example, the operation part 300 may be an indoor side cover of the fixing frame 200, a hinged door or a sliding door. In this embodiment, the structure to insert the operating part 300 into the fixing frame 200 or pull out the operation part 300 will be described.

The window glass 100 may include a single glass pane or a dual or triple glass panes for thermal insulation. When the opening part 110 is formed in the dual or triple glass pane, a spacer 130 is inserted between the glass pane and the glass pane, and a shield adhesive is interposed therebetween to seal.

For the sealing structure between the fixing frame 200 and the opening part 110, a packing material or an adhesive is used. If the adhesive is applied thin, the adhesive part may be damaged due to expansion and contraction by a temperature change or due to wind or shock added to the glass panel so that a crack may occur.

Considering the above-mentioned problem, the indoor ventilation system according to the present invention uses the first shield gasket 120 having elasticity to absorb micro-displacement. A shield material like silicone sealant is molded in advance, and the first shield gasket 120 is fit and attached to the inner circumference of the opening part 110.

FIG. 2 is a view schematically illustrating the indoor ventilation system according to the preferred embodiment of the present invention.

FIG. 3 is an exploded view schematically illustrating the structure of the indoor ventilation system according to the preferred embodiment of the present invention.

Figure 4:
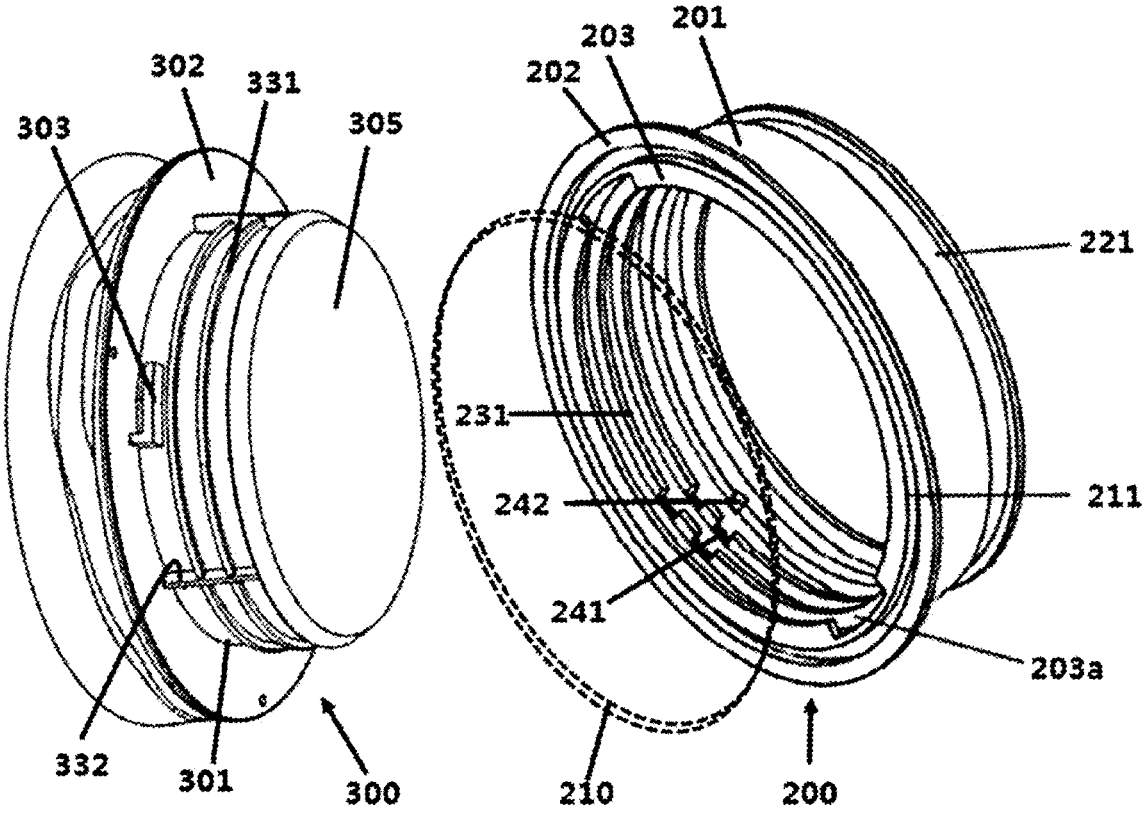
FIG. 4 is an exploded perspective view showing a fixing frame and an operation part of the indoor ventilation system according to the preferred embodiment of the present invention.
Figure 5:
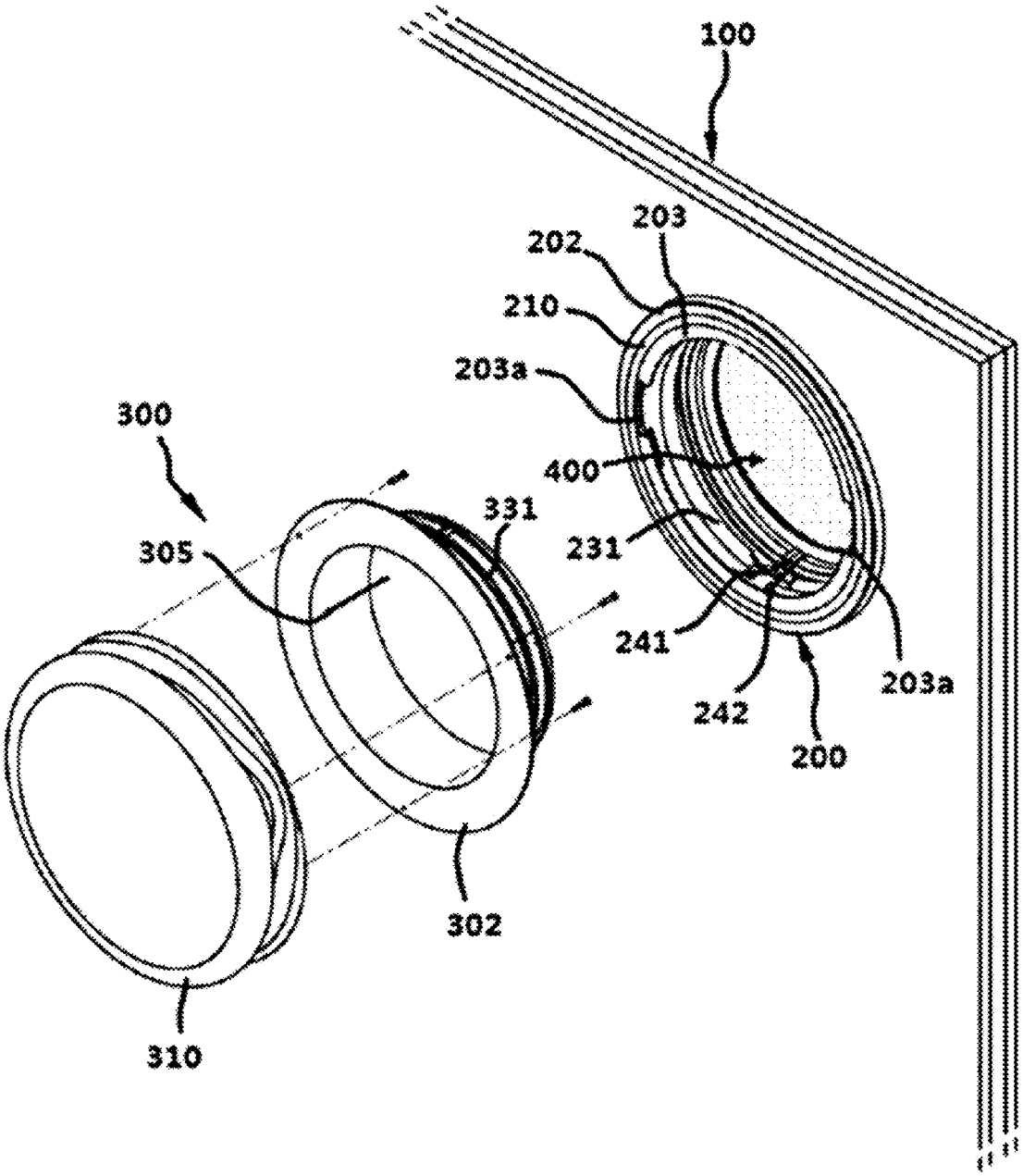
FIG. 5 is a perspective view illustrating a state where the operation part is separated from the fixing frame of the indoor ventilation system according to the preferred embodiment of the present invention.
Figure 6:
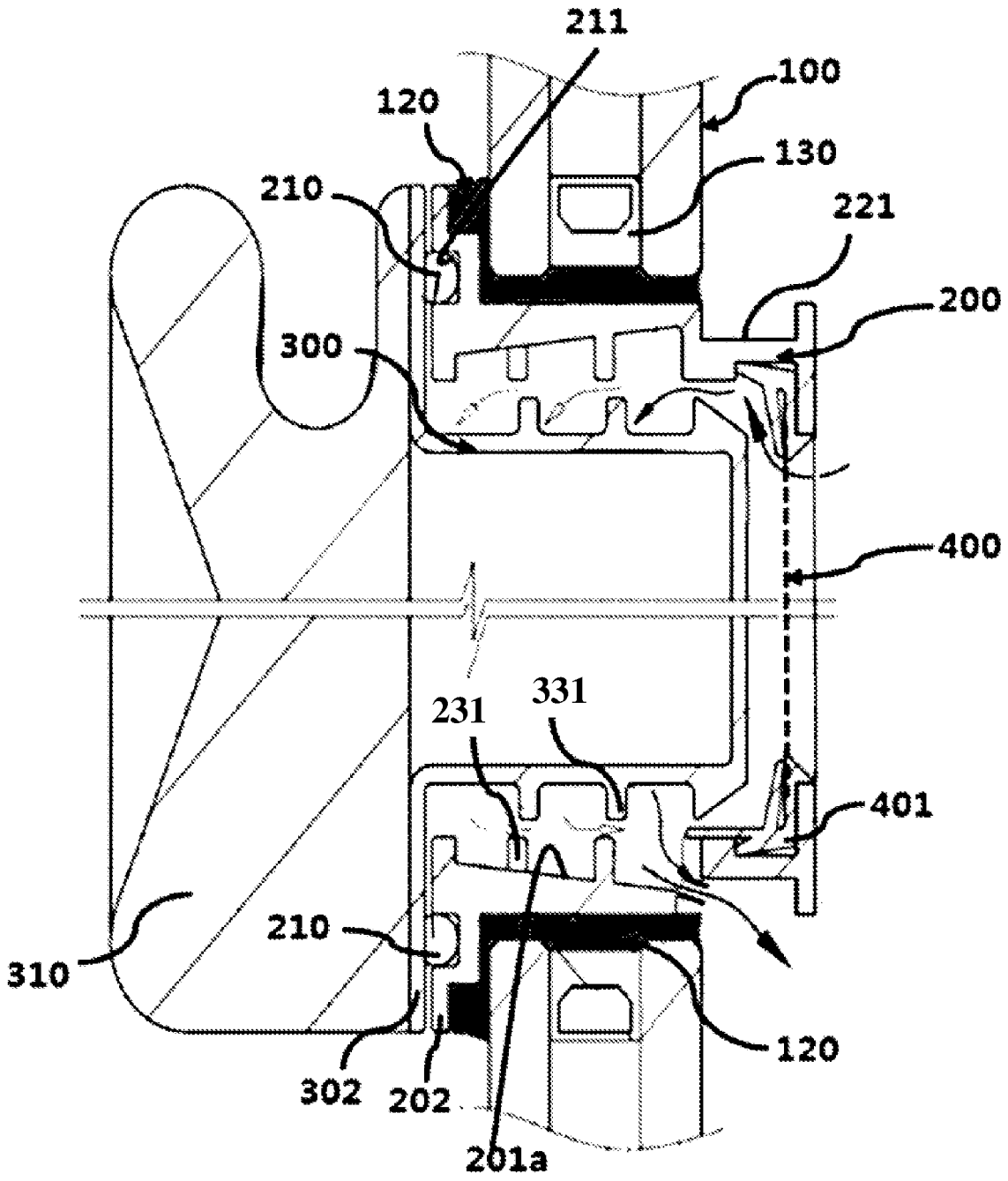
FIG. 6 is a sectional view illustrating a combined state of the fixing frame and the operation part of the indoor ventilation system according to the preferred embodiment of the present invention.

FIG. 4 is an exploded perspective view showing a fixing frame and an operation part of the indoor ventilation system according to the preferred embodiment of the present invention, FIG. 5 is a perspective view illustrating a state where the operation part is separated from the fixing frame of the indoor ventilation system according to the preferred embodiment of the present invention, and FIG. 6 is a sectional view illustrating a combined state of the fixing frame and the operation part of the indoor ventilation system according to the preferred embodiment of the present invention.

Referring to FIGS. 4 to 6, structures of the fixing frame and the operation part will be described.

The fixing frame 200 includes a cylindrical part 201 formed to be perforated, and an outer flange 202 protruding toward the outer circumference of the indoor side of the cylindrical part 201. The cylindrical part 201 is tightly inserted into the inner circumference of the first shield gasket 120 and protrudes toward the outside, and the flange 203 is caught to the glass panel at indoor sides.

The first shield gasket 120 is inserted and sealed between the flange 203 and the window glass 100 and between the inner circumference of the opening part 110 and the outer circumference of the cylindrical part 201. The first shield gasket 120 is adhered onto the opening part 110 and the fixing frame 200 by an adhesive so as to be sealed and fixed.

The operation part 300 can be inserted into or pulled out of the fixing frame 200. The operation part 300 includes a cylindrical part 301 to be inserted into the cylindrical part 201 of the fixing frame 200, a flange 302 protruding from the outer circumference of the rim of the indoor side of the cylindrical part 301, and a bottom surface 305 formed by the closed bottom surface of the outdoor side of the cylindrical part 301.

A second gutter 211 is formed at the flange of the indoor side of the fixing frame 200 to insert the shield gasket. The second shield gasket 210 is inserted into the second gutter 211. The second shield gasket 210 is sealed to the flange 302 of the operation part 300 to be sealed between the fixing frame 200 and the operation part 300 when the operation part 300 is inserted and fixed into the fixing frame 200.

There are a screw coupling structure and a sliding structure in order to combine the operation part 300 with the fixing frame 200. The inner surface of the cylindrical part 201 of the fixing frame 200 and the outer surface of the cylindrical part 301 of the operation part 300 respectively have screw portions corresponding to each other so that the fixing frame 200 and the operation part 300 can be screw-coupled with each other. In addition, the inner surface of the cylindrical part 201 of the fixing frame 200 and the outer surface of the cylindrical part 301 of the operation part 300 may be configured to push in and pull out without any structure.

The configuration to simply push in and pull out without using the screw coupling structure requires a fixing combination part to seal while pressing the second shield gasket 210. That is, a combination part to insert and fix the operation part 300 into the fixing frame 200 is needed.

In this embodiment, an inner flange 203 is formed on the inner rim of the indoor side of the fixing frame 200, and a plurality of insertion grooves 203*a* are formed in the inner flange 203. Combination parts 303, which pass through the insertion grooves 203*a* and are caught to the inner flange 203 when the operation part 300 is rotated, are protrudingly formed on the outer surface of the cylindrical part 301 of the operation part 300. The insertion grooves 203*a* and the combination parts 303 correspond to each other, and are formed in at least a pair. The insertion grooves 203*a* and the combination parts 303 are combined and balanced with each other in a pair at the corresponding position.

The fixing frame 200 is mounted to protrude towards outdoor side from the opening part 110. A first gutter 221 is formed on the outer circumferential surface of the protruding fixing frame 200. The first gutter 221 is a ring-shaped groove, and rainwater is collected and drops down through the first gutter 221. Rainwater rapidly drops down through the first gutter 221 of the fixing frame 200, and has excellent watertightness by the first shield gasket 120.

In the meantime, in the state where the operation part 300 is inserted and fixed into the fixing frame 200, since the second shield gasket 210 seals between the operation part 300 and the fixing frame 200, it can block rainwater from entering. However, even though the operation part 300 is mounted, rainwater may enter between the fixing frame 200 and the operation part 300. If the operation part 300 is pulled out and removed, rainwater can enter indoors as it is. The air filter 400 is mounted at the end of the inside of the fixing frame 200, but it cannot block rainwater. There may be a mold due to remaining rainwater even though rainwater does not enter indoors, and the operation part 300 cannot be pulled out since it is frozen in winter.

Now, a structure for preventing rainwater from entering will be described. A plurality of ring-shaped shielding walls 231 are formed on the inner circumferential wall of the fixing frame 200, and a plurality of ring-shaped shielding walls 331 are formed on the outer circumferential wall of the operation part 300.

A guider 332 is formed on the ring-shaped shielding walls 331 of the operation part 300 perpendicular to the longitudinal direction of the shielding walls 331. Preferably, the guider 332 protrudes higher than the ring-shaped shielding walls 331 of the operation part 300. The guider 332 prevents the ring-shaped shielding walls 331 of the operation part 300 from being caught to the ring-shaped shielding walls 231 of the fixing frame 200 when the operation part 300 is inserted into the fixing frame 200.

A plurality of the guiders 332 may be formed at regular intervals, and preferably, four or more guiders 332 are formed. The guider 332 is not formed on the ring-shaped shielding walls 231 of the fixing frame 200. Because there is a closed space where introduced water does not flow if the guider is formed on the fixing frame 200, the guider is not formed on the fixing frame 200.

In order to drain rainwater when rainwater enters, a drain hole 242 for draining water downwards is formed in the bottom surface of the outside of the fixing frame 200.

Flow grooves 241 are formed in the ring-shaped shielding wall 231 of the fixing frame 200 so that water flows into the drain hole 242. The drain hole 242 and the flow grooves 241 are located on the lower side when the fixing frame 200 is mounted. A dispersion protrusion is interposed between the flow grooves 241 so that water branches off into two sides and flows into the flow grooves 241 formed at both sides of the dispersion protrusion. Therefore, the flow grooves 241 prevent water from overflowing due to the bottleneck state.

Especially, the cylindrical part 201 of the fixing frame 200 has an inclined surface 201*a* formed on the inner circumferential wall of the cylindrical part 201 to be inclined from the indoor side to the outdoor side. So, the water flows from the indoor side to the outdoor side by the inclined surface 201*a* and is discharged out through the drain hole.

The operation part 300 may be formed in a hat shape. That is, the operation part 300 has a hat-shaped hollow structure, namely, a cylindrical storage structure when viewed from the inside. The operation part 300 can store things in a storage space, and may have a good design if the cover 310 is attached to the operation part 300. The cover 310 and the operation part 300 can be combined with each other via bolt coupling, hook coupling, screw coupling, or others, or can be adhered to each other via an adhesive. When the cover 310 is attached, it is preferable to form a hand-grip part for inserting the operation part 300 into the fixing frame 200 or pulling out the operation part 300.

Using the hollow structure and the cover 310 of the operation part 300, the present invention may be individually configured as a small-sized water tank, an electronic clock, a lamp, a flowerpot plant, a wireless speaker, a piggy-bank, a mirror-mounted storage box, and others.

The operation part 300 is inserted into the fixing frame 200 to close the ventilation window and is pulled out of the fixing frame 200 to open the ventilation window. When the operation part 300 is pulled out, the air filter 400 mounted at the end of the indoor side of the fixing frame 200 filters dust or foreign matters. When the operation part 300 is pulled out, ventilation is performed, and the air filter 400 blocks dust or foreign matters from entering.

The operation part 300 pulled out of the fixing frame 200 to open the ventilation window requires a holder. The operation part 300 may be held somewhere else or may be held on the fixing frame 200.

Figure 7:
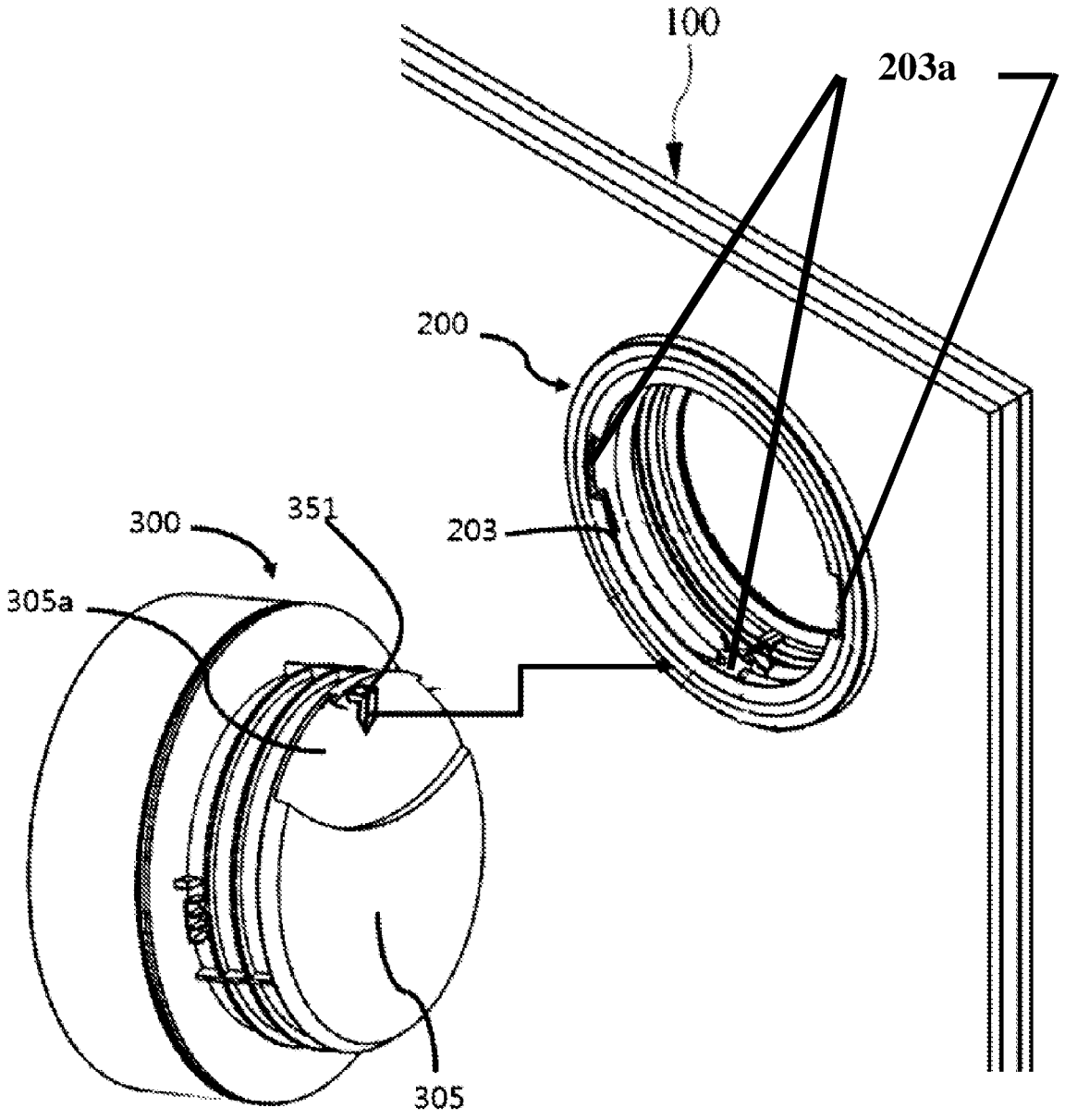
FIG. 7 is a view showing a holding structure of the operation part of the indoor ventilation system according to the preferred embodiment of the present invention.

FIG. 7 is a view showing a holding structure of the operation part of the indoor ventilation system according to the preferred embodiment of the present invention.

A hook 351 is formed at the end portion of the outer surface of the cylindrical part 301 of the operation part 300. For an example, the hook 351 is caught to the inner flange 203 of the fixing frame 200. For another example, the hook 351 may be a tapered suspension caught to the insertion groove 203*a*. As described above, because the operation part 300 can be simply caught to the fixing frame 200, it is easy to pull out and store the operation part 300 and to recombine the operation part 300 with the fixing frame 200.

The indoor ventilation system according to the present invention makes it possible to ventilate air indoors by opening and closing the openable ventilation window mounted in the opening part of the window glass. Because the opening part is small, it can greatly reduce the risk of falling of children and improve the safety coefficient. Moreover, the indoor ventilation system can enhance effects of sound insulation and thermal insulation due to the close contact with the glass window. Furthermore, the cover part may be customized to greatly improve space utilization and beauty of the window body.

Meanwhile, the opening part 110 is formed in the window glass 100, the fixing frame 200 is mounted on the opening part 110, and the sealing structure is formed between the opening part 110 and the fixing frame 200. In order to enhance sealability, the first shield gasket 120 may be used.

However, if the fixing frame 200 is just inserted into the shield gasket, the fixing frame 200 may be separated from the shield gasket to the indoor side. Therefore, a silicone sealant adhesive is injected between the fixing frame 200 and the opening part 110 to seal, and the first shield gasket is mounted.

If the adhesive is used, when the fixing frame 200 is breaks down, a user cannot easily detach the fixing frame 200 from the indoor side on site.

In another embodiment of the present invention, the indoor ventilation system has a first shield gasket with a different structure that the fixing frame 200 can be easily inserted and can be easily dismantled from the indoor side.

Figure 8:
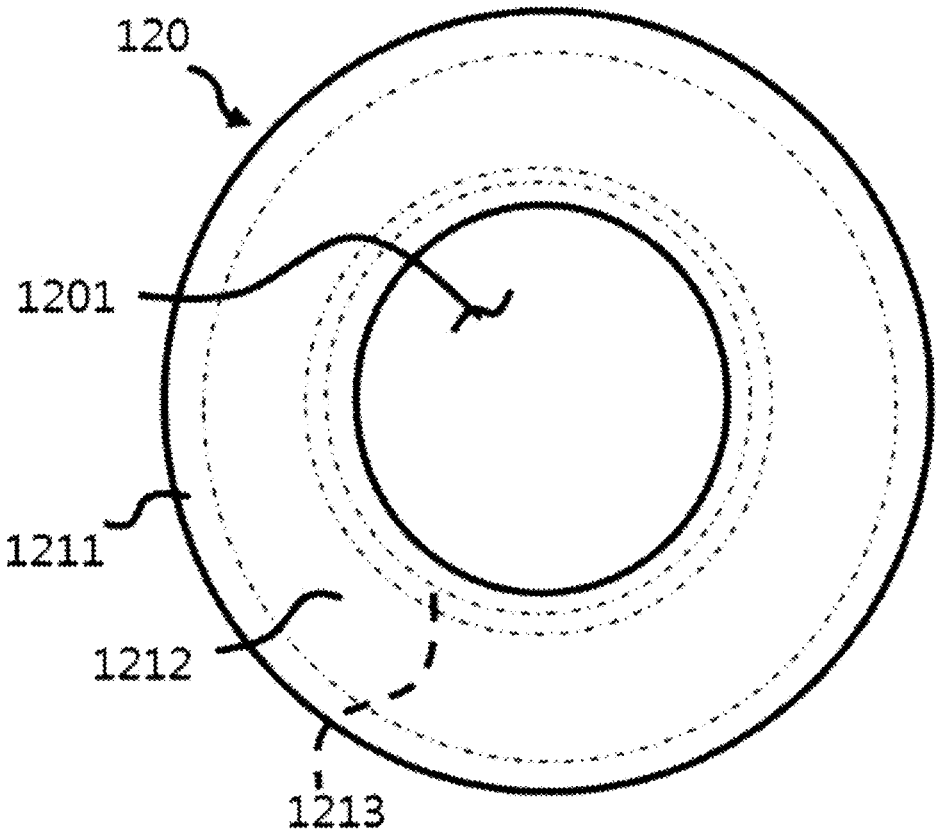
FIG. 8 is a front view illustrating a state before a first shield gasket is mounted.

FIG. 8 is a front view illustrating the state before the first shield gasket of the indoor ventilation system is mounted. Referring to FIG. 8, the first shield gasket 120 is formed in a doughnut shape having a through hole part 1201 formed at the center of a disc plate made with an elastic material, and includes: an adhesive surface 1211 to be adhered on the indoor glass panel 100 of the opening part 110; and a body part 1212 extending from the rim of the adhesive surface 1211 to the inner circumference of the through hole part 1201 to correspond to the width of the inner circumference of the opening part 110.

The first shield gasket 120 further includes an elastic part 1213 protruding from the rim of the inner circumference of the through hole part 1201 in the direction of the outdoor side.

Figure 9:
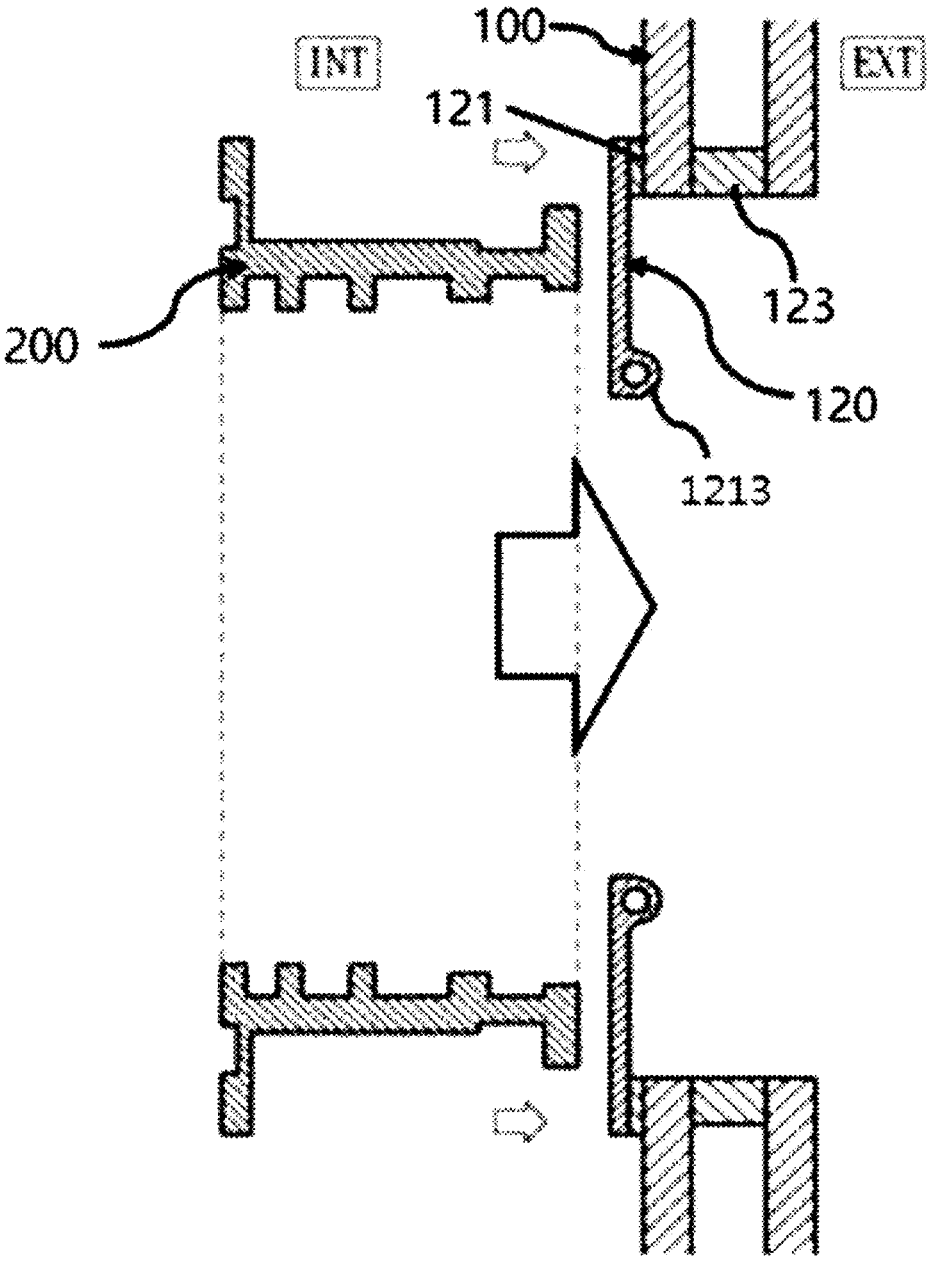
FIG. 9 is a sectional view schematically illustrating a mounting process of the first shield gasket between the fixing frame and a glass opening part.

FIG. 9 is a view illustrating a mounting process of the first shield gasket of the indoor ventilation system according to the present invention.

The first shield gasket 120 is formed in a doughnut shape having the through hole part 1201 formed at the center thereof. The adhesive surface 1211 of the first shield gasket 120 is adhered onto the indoor window glass 100 around the opening part 110. For instance, the first shield gasket 120 may be adhered onto the window glass 100 using an adhesive 121.

After the doughnut-shaped first shield gasket 120 is adhered onto the indoor window glass 100, the fixing frame 200 is pushed into the opening part 110. The cylindrical part 201 of the fixing frame 200 pushes the body part 1212 of the first shield gasket 120 into the opening part 110.

Figure 10:
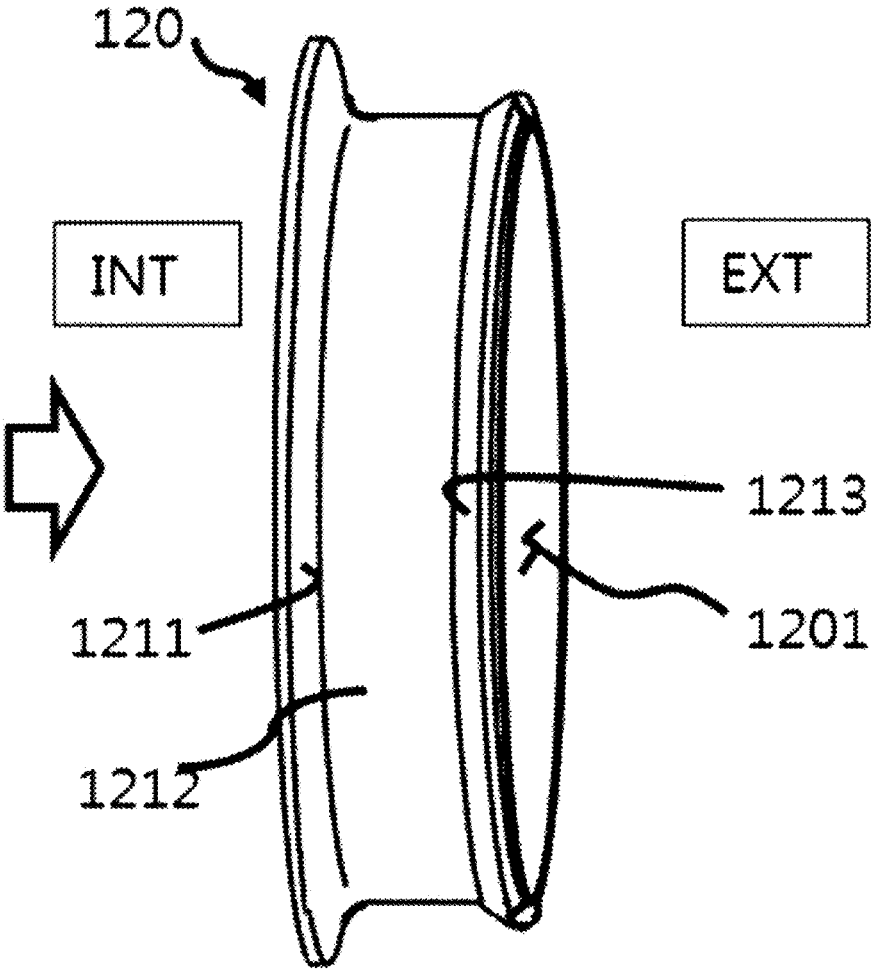
FIG. 10 is a perspective view schematically illustrating a state where the first shield gasket is mounted.

FIG. 10 is a view illustrating the state after the first shield gasket of the indoor ventilation system according to the present invention is mounted.

When the cylindrical part 201 of the fixing frame 200 pushes the body part 1212 of the first shield gasket 120, as shown in FIG. 10, the first shield gasket 120 is transformed into a cap having the through hole part 1201. Here, the diameter of the through hole part 1201 is smaller than the outer diameter of the cylindrical part 201 of the fixing frame 200. Therefore, when the fixing frame 200 is pushed in, the cylindrical part 201 passes through the through hole part 1201 since the diameter of the through hole part 1201 gets larger while the body part 1212 is expanded.

Figure 11:
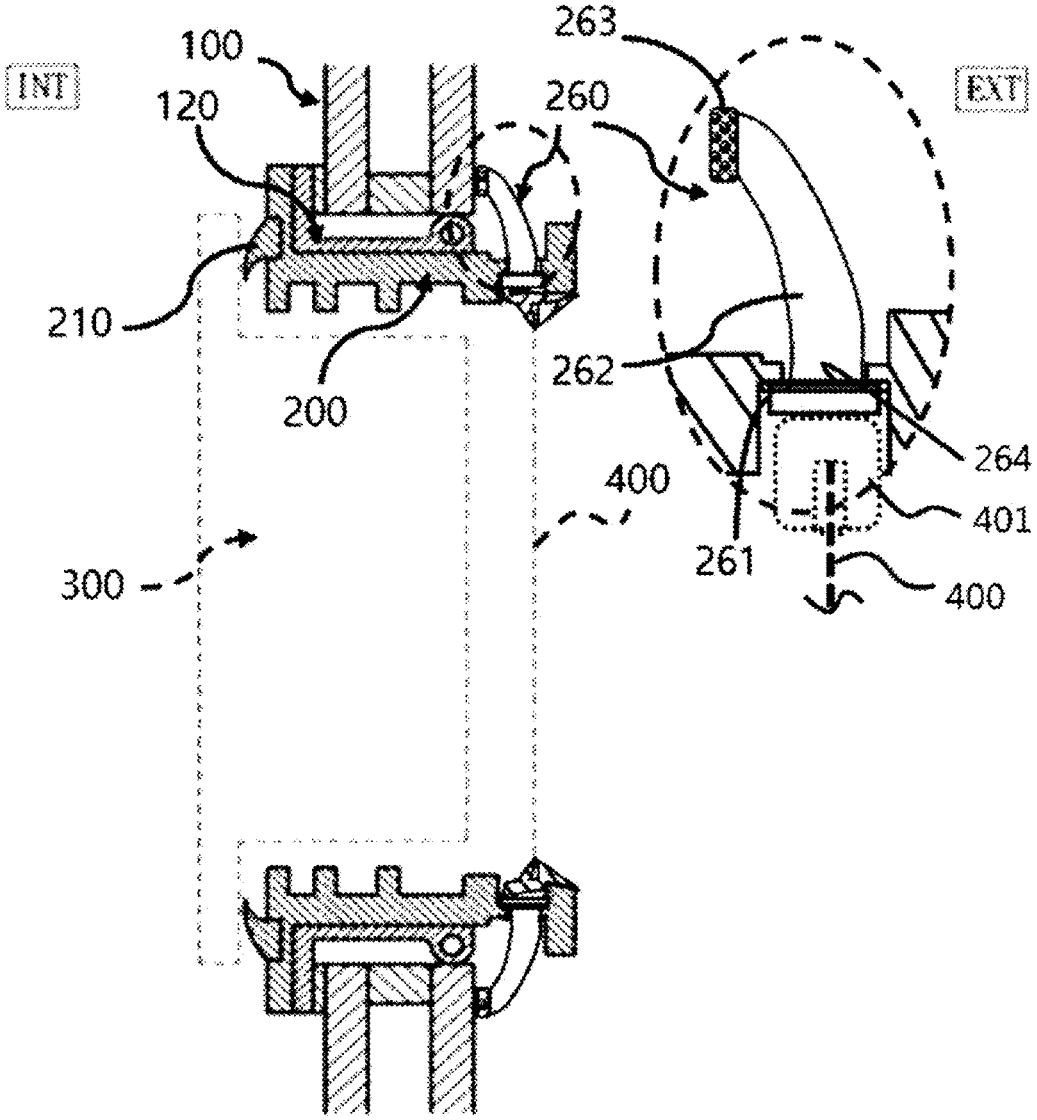
FIG. 11 is a sectional view schematically illustrating a state where the first shield gasket is mounted between the fixing frame and a glass opening part.

FIG. 11 is a sectional view schematically illustrating the state where the first shield gasket of the indoor ventilation system according to the present invention is mounted.

After the first shield gasket 120 is attached to the indoor side, the fixing frame 200 is pushed in. The width of the body part 1212 of the first shield gasket 120 corresponds to the width of the opening part 110. The body part 1212 of the first shield gasket 120 is tightly inserted between the inner circumference of the opening part 110 and the outer circumference of the fixing frame 200.

The first shield gasket 120 further includes an elastic part 1213 protruding when the inner circumference of the through hole part 1201 is turned inside out. The elastic part 1213 can seal a space between the inner circumference of the outdoor glass panel of the opening part 110 and the cylindrical part of the fixing frame 200 by applying strong pressure.

The elastic part 1213 may be folded into a round shape by turning inside out the inner circumference of the through hole part 1201. Moreover, the elastic part 1213 may have a round or oval protrusion part having an empty space part formed therein. Alternatively, the elastic part 1213 has a folded and inclined wing structure and is tightly inserted between the outer surface of the fixing frame 200 and the inner circumference of the opening part 110 to provide elasticity. The elastic part 1213 is not limited in its form or structure.

Additionally, the indoor ventilation system according to the present invention further includes a clamping means 260 for fastening the fixing frame 200. The clamping means 260 is mounted on the fixing frame 200 protruding toward outdoor side from the opening part 110 in order to prevent the fixing frame 200 from being pushed toward the indoor side.

The clamping means 260 may be formed in a hook shape which is inserted and fixed into a hook hole formed in the fixing frame 200 protruding toward outdoor side from the opening part 110.

The hook-shaped clamping means 260 includes: a head part 261 caught to the hook hole; a hook part 262 which protrudes from the head part 261, is inserted into the hook hole and has a front part being sealed to the glass panel; and a pad part 263 attached to the front part of the hook part 262 and being sealed to the glass panel. In addition, the clamping means 260 further includes a packing 264 for preventing rainwater from infiltrating into the hook hole.

Moreover, the clamping means 260 has the bent hook rotatably hinged on the outer surface of the fixing frame 200, and the fixing frame 200 is inserted. After that, the clamping means 260 is rotated to fix the fixing frame 200 while being sealed to the outdoor side glass surface. The rotating type structure is configured such that an end portion of the elastic hook is rotatably mounted at the cylindrical part 201 of the fixing frame 200 or is detachably mounted. That is, the clamping means may have one of various forms and is not limited in its structure.

As described above, the edge of the first shield gasket 120 which is formed in the doughnut shape is attached to the indoor glass panel. The central portion of the first shield gasket 120 is pushed and fit into the opening part by the fixing frame 200. The first shield gasket 120 is mounted between the inner circumference of the opening part 110 and the fixing frame 200 while the central portion of the shield gasket 120 protrudes out in a cylindrical form.

Therefore, the first shield gasket 120 can be easily inserted and mounted on site. The shield gasket improves adhesion performance since maintaining elasticity in a forcibly bent state. The first shield gasket 120 may have additional elastic parts 1213 in order to prevent rainwater from entering by compressing the inner rim of the outdoor side of the opening part 110 more strongly. Furthermore, because the fixing frame 200 and the first shield gasket 120 are mounted in a simply inserted state, the fixing frame 200 can be easily detached from the indoor side.

Additionally, because the fixing frame 200 is supported to apply elasticity to the outdoor side by the clamping means 260 of the fixing frame 200, the fixing frame 200 presses the first shield gasket 120 in order to enhance adhesion performance and prevent separation of the fixing frame 200.

Figure 12:
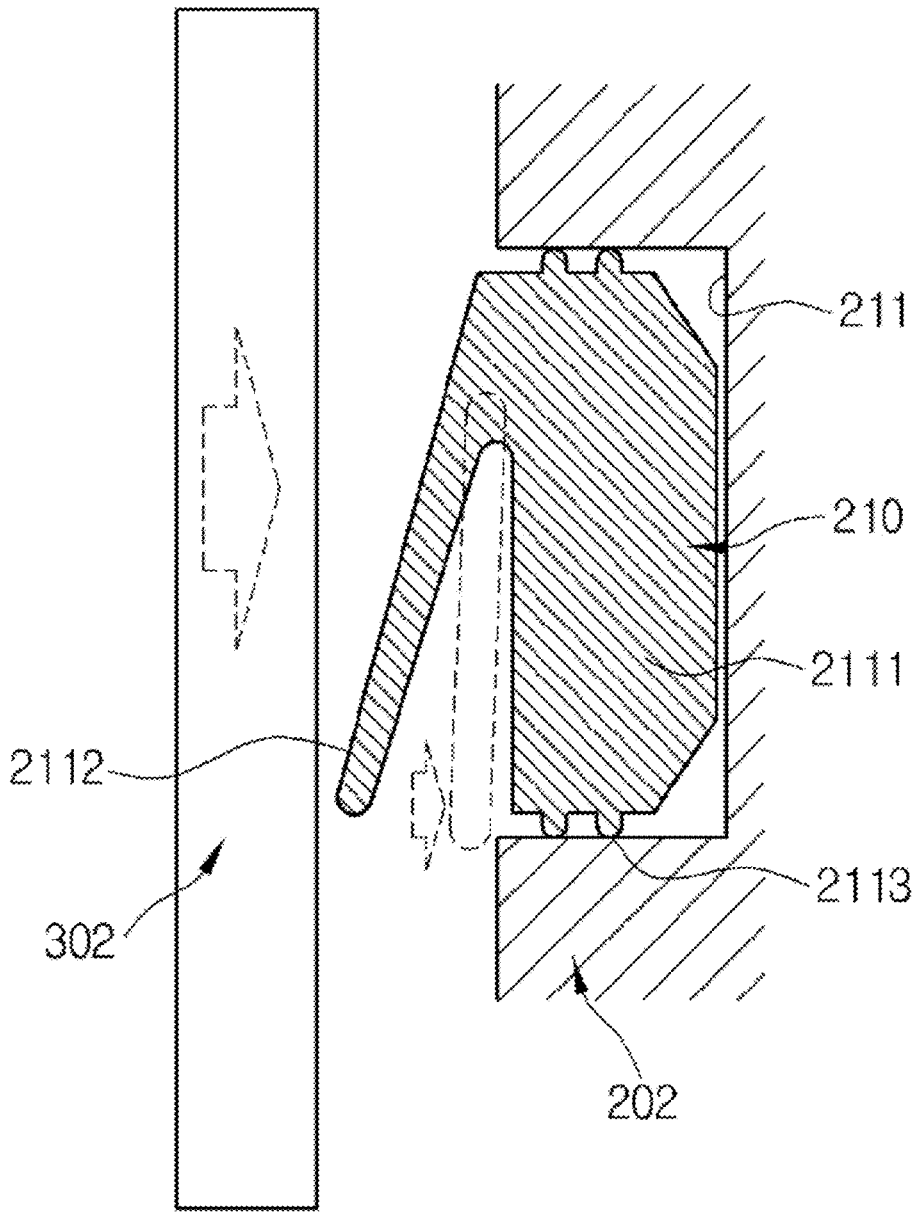
FIG. 12 is a detailed view of FIG. 6 for explaining a second shield gasket of the indoor ventilation system according to the preferred embodiment of the present invention.

FIG. 12 is a detailed view for explaining the second shield gasket 210 of the indoor ventilation system shown in FIG. 6, according to the preferred embodiment of the present invention.

The second gutter 211 is formed on the outer flange 202 of the fixing frame 200, and the second shield gasket 210 is inserted and mounted into the second gutter 211 and is compressed by the flange 302 of the operation part 300 so as to be sealed. The second shield gasket 210 may be an O-ring having a circular or oval cross section. Such an O-ring may deteriorate shielding effect since the contact surface being sealed to the flange 302 of the operation part 300 is small.

Therefore, the present invention proposes a structure of the second shield gasket 210 illustrated in FIG. 12.

The second shield gasket 210 includes: a body part 2111 inserted into the second gutter 211; and a wing part 2112 of which one end is connected integrally with the body part 2111 and the other end is separated from the body part 2111 at a predetermined angle.

When the second shield gasket 210 is inserted and mounted into the second gutter 211 and the operation part 300 is inserted and fixed into the fixing frame 200, the flange 302 of the operation part 300 pushes and compresses the wing part 2112. Since the flange 302 of the operation part 300 and the wing part 2112 of the second shield gasket 210 are sealed each other, the contact area is widened and shielding effect increases.

Moreover, one or two protrusions 2113 protruding linearly are formed on the circumferential surface of the body part 2111. When the body part 2111 of the second gutter 211 is inserted, the protrusions 2113 are sealed to the side wall of the second gutter 211. Therefore, even though the operation part 300 is separated from the fixing frame 200, the second shield gasket 210 is not separated.

Not shown in the drawing, but a line-shaped groove on which the protrusion 2113 is put may be formed in the side wall of the second gutter 211 or a retaining protrusion may be formed on the side wall of the second gutter 211 so that the protrusion 2113 can climb over the retaining protrusion while being compressed when the body part 2111 is pressed to be inserted into the second gutter 211.

In order to maintain the shielded state between the fixing frame 200 and the operation part 300 by the second shield gasket 210, a combining means for fixing and combining the fixing frame 200 and the operation part 300 with each other when the operation part 300 is inserted into the fixing frame 200 is required.

Figure 13:
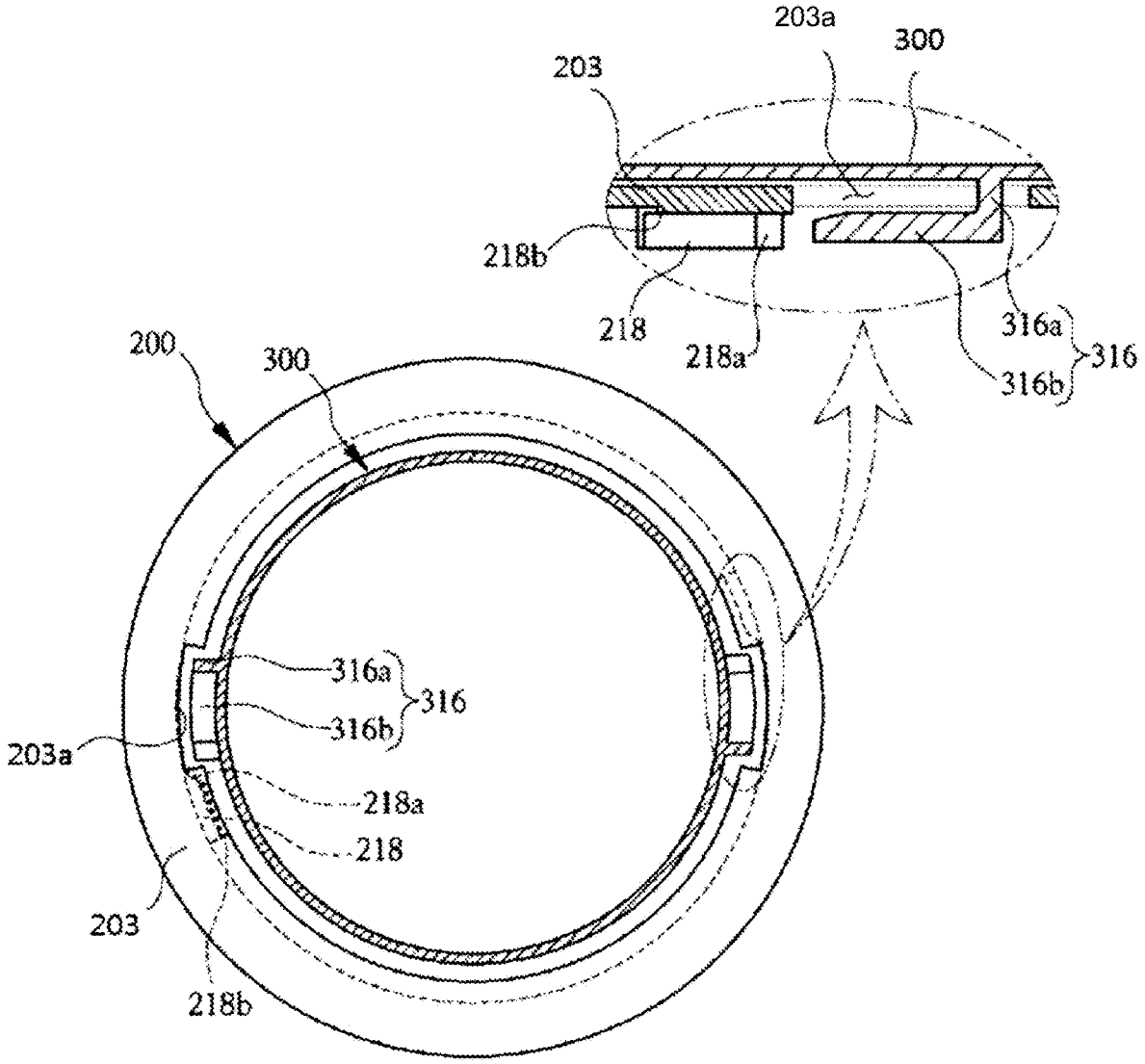
FIG. 13 is a sectional view illustrating the combining part of the indoor ventilation system according to the preferred embodiment of the present invention.
Figure 14:
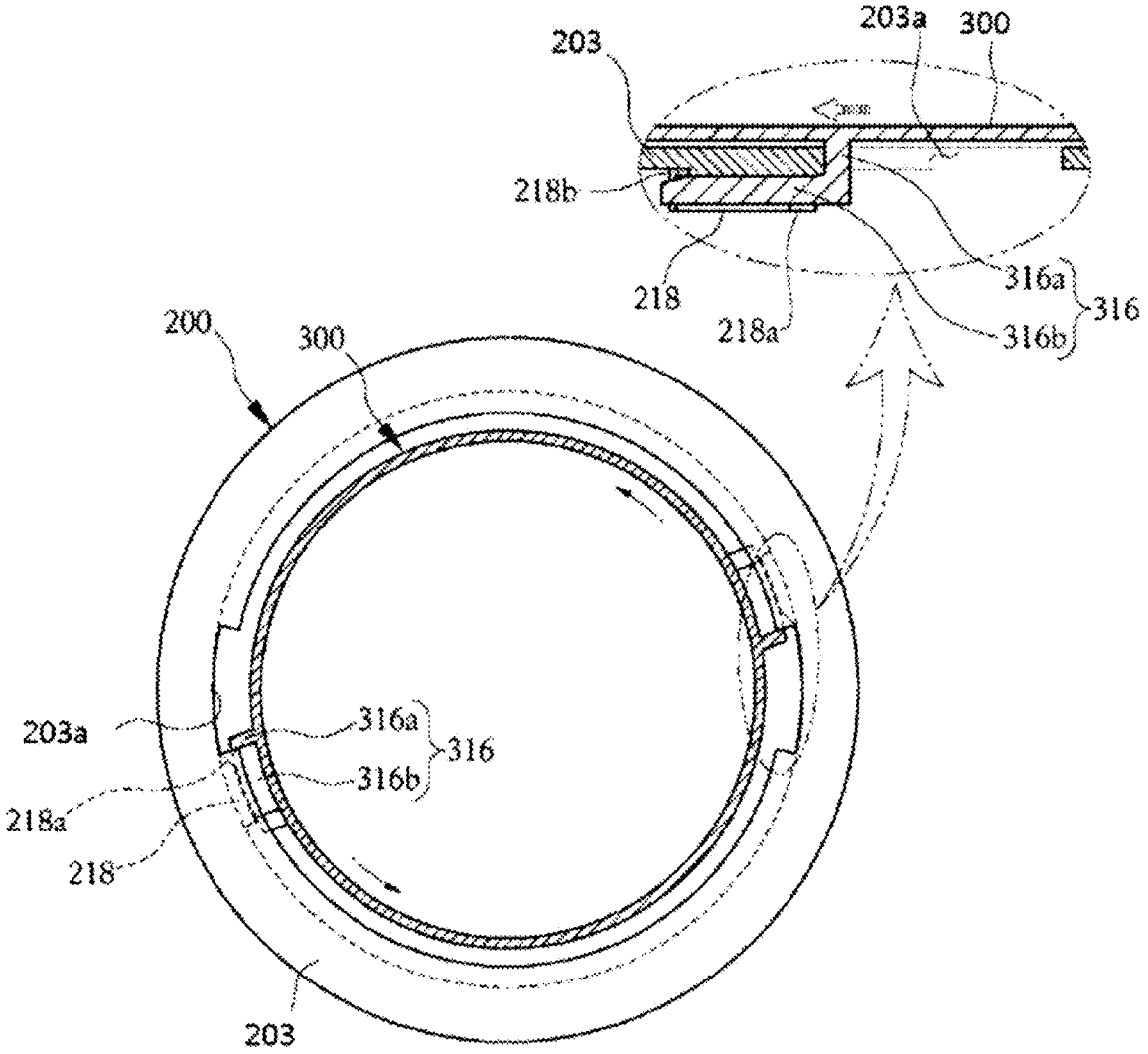
FIG. 14 is a view for explaining a combined structure of the fixing frame and the operation part of the indoor ventilation system according to the preferred embodiment of the present invention.

FIG. 13 is a view for explaining combination between the fixing frame and the operation part of the indoor ventilation system according to the preferred embodiment of the present invention, and FIG. 14 is a view for explaining a combined structure of the fixing frame and the operation part of the indoor ventilation system according to the preferred embodiment of the present invention.

The operation part 300 includes a combining part 316, which has a retaining part 316*a* protruding from the outer circumference of the operation part 300 in a perpendicular to the longitudinal direction of the outer circumference and a compression coupling part 316*b* formed at an end of the retaining part 316*a* in a circumferential direction. The fixing frame 200 includes a retained piece protruding from the inner circumference thereof in the circumferential direction and having the width corresponding to the length of the retaining part 316*a*.

The retained piece formed on the inner circumference of the fixing frame 200 may substitute for the inner flange 203. When the operation part 300 is inserted into the fixing frame 200 and is rotated, the compression coupling part 316*b* is located and pressed at the outdoor side of the retained piece. Therefore, the operation part 300 can be combined and fixed with the fixing frame 200. The compression coupling part 316*b* or the retained piece may have an inclined part to be firmly fastened when being rotated and combined.

As shown in FIGS. 13 and 14, the inner flange 203 of the fixing frame 200 has a plurality of the insertion grooves 203*a*, and the operation part 300 has a plurality of the combining parts 316 corresponding to the insertion grooves 203*a*. When the combining parts 316 are inserted into the inner flange 203 through the insertion grooves 203*a* and the operation part 300 is rotated, the compression coupling part 316*b* of the combining part 316 is fit and fixed to the outdoor side of the inner flange 203.

Furthermore, the inner flange 203 to which the compression coupling part 316*b* is fit has an inclined part 218*a* and a compression protruding part 218*b*. When the operation part 300 is inserted and rotated, it interferes with the compression coupling part 316*b* and is forcibly fit and combined with the inner flange, and pressing power is applied to the operation part 300 in the direction of the fixing frame 200.

As described above, because the operation part 300 is combined with the fixing frame 200 by applying pressing power to the operation part 300 in the direction of the fixing frame 200, the second shield gasket 210 is compressed to maintain the shielded state. Especially, because the wing part 2112 is compressed to the second shield gasket 210, the contact area gets widened and shielding performance is improved.

The present invention proposes a first shield gasket having another different structure.

Figure 15:
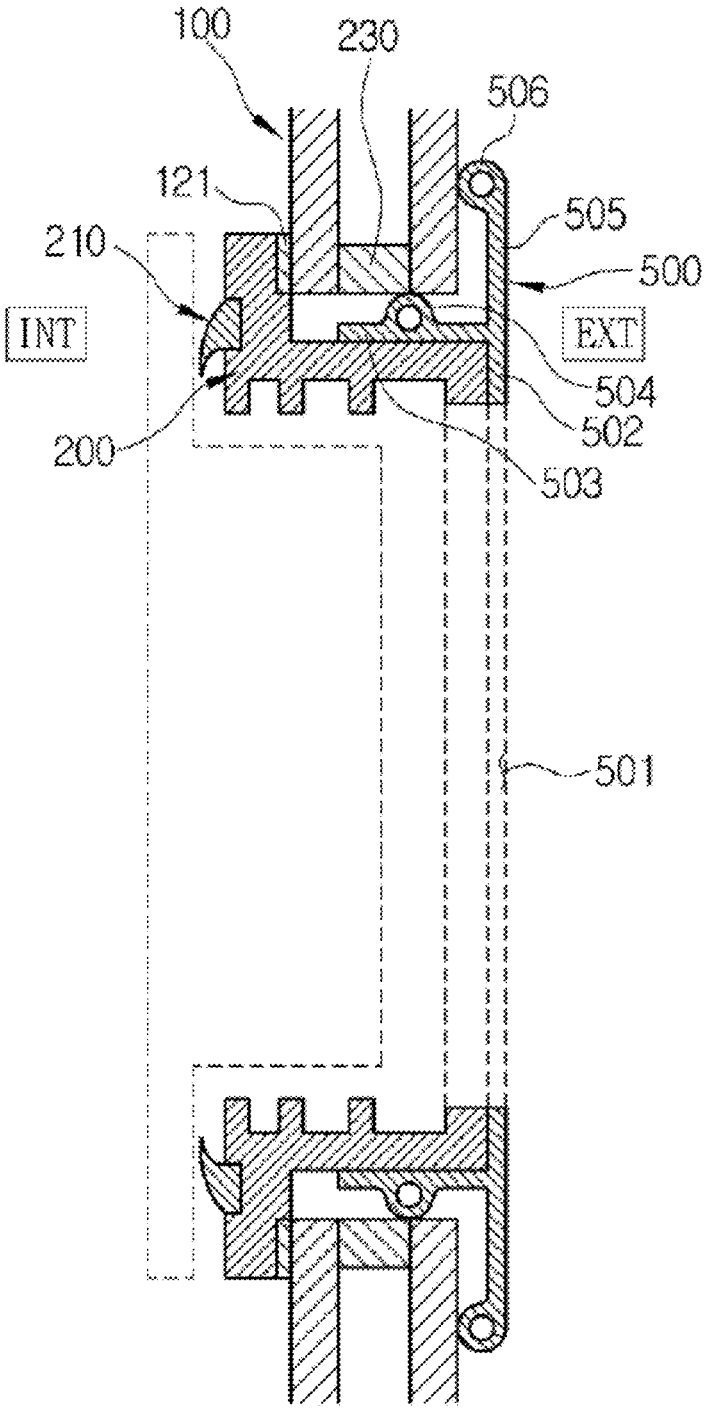
FIG. 15 is a sectional view schematically illustrating the structure of the indoor ventilation system having an exterior cover shield gasket according to another preferred embodiment of the present invention.
Figure 16:
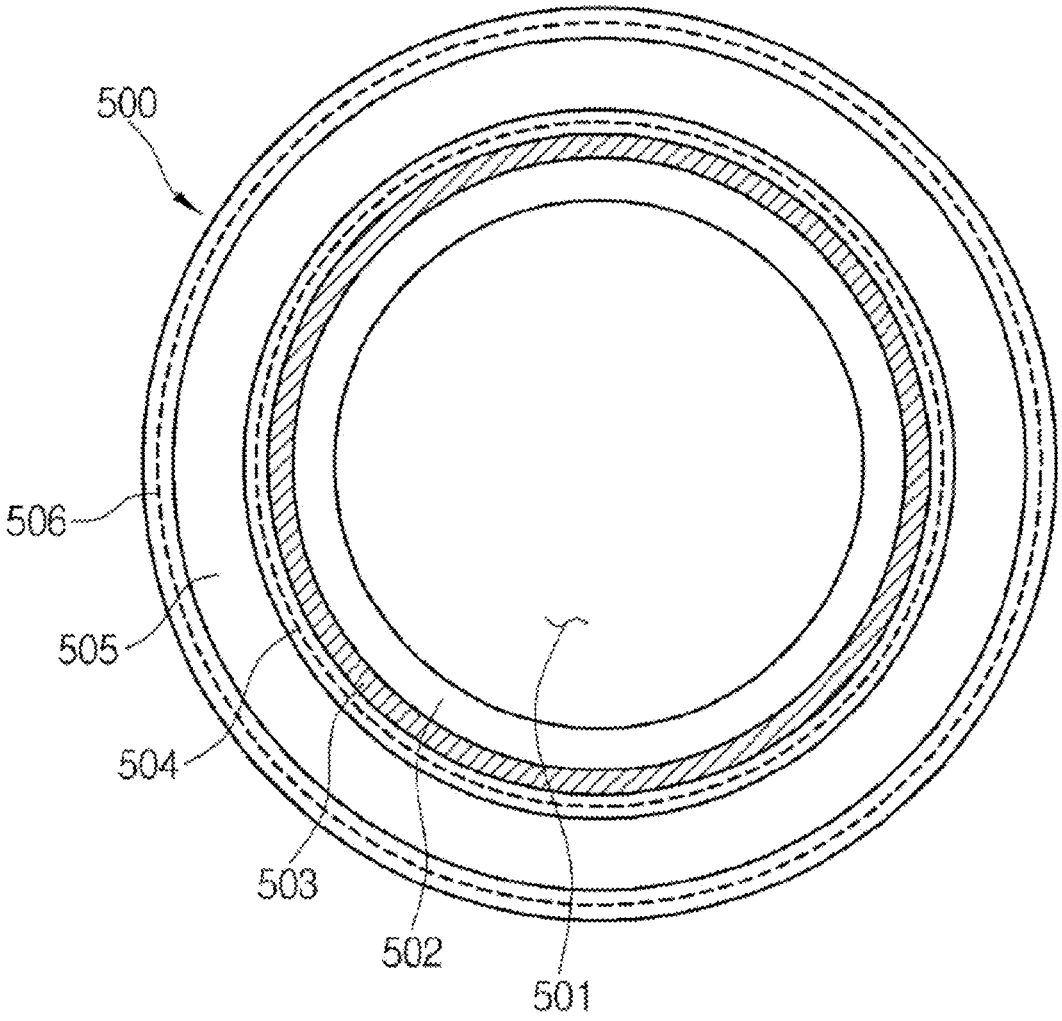
FIG. 16 is a front view schematically illustrating the exterior cover shield gasket of the present invention.
Figure 17:
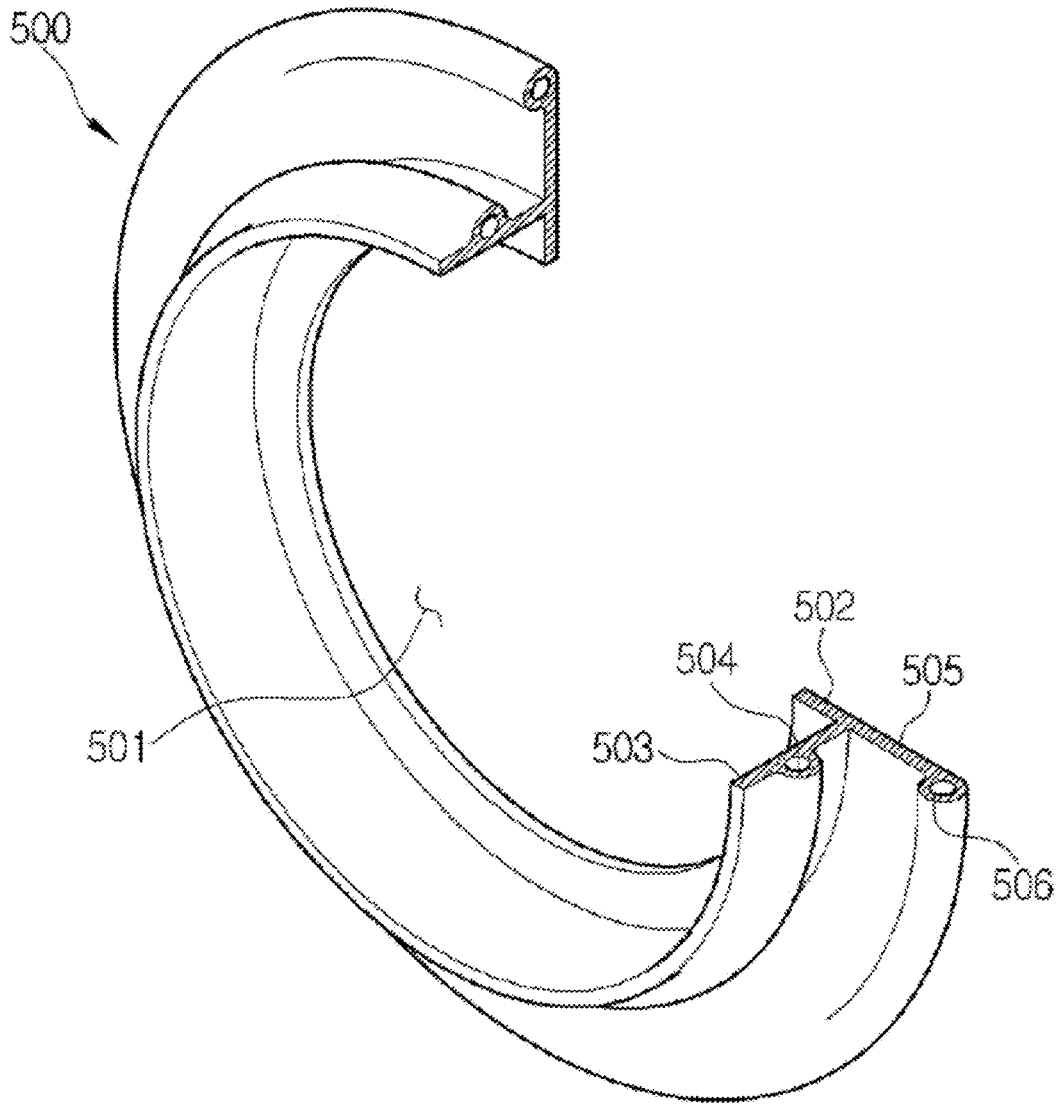
FIG. 17 is a perspective view schematically illustrating a partial cross section of the exterior cover shield gasket of the present invention.

FIG. 15 is a sectional view schematically illustrating the structure of the indoor ventilation system having an exterior cover shield gasket according to another preferred embodiment of the present invention, FIG. 16 is a front view schematically illustrating the exterior cover shield gasket of the present invention, and FIG. 17 is a perspective view schematically illustrating a partial cross section of the exterior cover shield gasket of the present invention.

The opening part 110 is formed in the window glass 100, the fixing frame 200 is inserted and mounted into the opening part 110, the operation part 300 is inserted into the fixing frame 200 to close the ventilation window by blocking the fixing frame 200, and the operation part 300 is drawn out to open the ventilation window by opening the fixing frame 200.

In this embodiment of the present invention, the indoor ventilation system further includes an exterior cover shield gasket 500 in order to shield between the opening part 110 and the fixing frame 200 and to prevent rainwater from entering.

The exterior cover shield gasket 500 has a ring-shaped structure for blocking the opening part 110 from the exterior (EXT), and includes: a through hole 501 formed in the middle thereof; a rim cover part 502 formed in a ring shape with a predetermined width relative to the through hole 501 to cover the exterior rim portion of the fixing frame 200; a cylindrical shield gasket part 503 protruding from the indoor side of the front rim cover part 502 and interposed between the outer circumference of the fixing frame 200 and the inner circumference of the opening part 110; a first elastic part 504 protruding from the outer circumference of the cylindrical shield gasket part 503; an exterior cover part 505 extending from the rim cover part 502 to cover the outer face of the opening part 110; and a second elastic part 506 protruding from the inside rim of the exterior cover part 505 to elastically be sealed to the glass panel 100.

In this embodiment, the fixing frame is divided into two parts. The fixing frame 200 inserted from the indoor side has the ring-shaped structure and has the outer flange 202 formed on the indoor side. The exterior cover shield gasket 500 is mounted on the fixing frame inserted from the outdoor side.

First, the exterior cover shield gasket 500 is mounted from the outdoor side of the opening part 110. The ring-shaped fixing frame 200 is fit and fixed from the indoor side of the opening part 110. The outer circumference of the cylindrical part 201 of the fixing frame 200 is fit onto the inner circumference of the cylindrical shield gasket part 503 of the exterior cover shield gasket 500 so that the two parts are forcibly fit to each other. In this instance, the exterior rim of the cylindrical part 201 of the fixing frame 200 is sealed to the rim cover part 502 of the exterior cover shield gasket 500. The first elastic part 504 is formed on the outer circumference of the cylindrical shield gasket part 503 of the exterior cover shield gasket 500. The first elastic part 504 is compressed when the fixing frame 200 is inserted and fixed, and is sealed to the inner circumference of the opening part 110 to seal the in-between space of the opening part. Additionally, the inside rim of the exterior cover part 505 is flexibly bent in the direction of the glass panel 100 and has the second elastic part 506. The exterior cover part 505 is sealed to the glass panel when the second elastic part 506 is pressed.

Here, not shown in the drawing, but the second elastic part 506 has a drain hole, and the exterior cover shield gasket 500 is mounted in such a way that the drain hole is located at the bottom surface. Therefore, rainwater flowing between the second elastic part 506 and the glass panel 100 from the top or the side flows between the first elastic part 504 and the exterior cover part 505, and then, is drained out through the drain hole. Moreover, rainwater introduced through the through hole 501 flows down by the drain structure formed between the fixing frame 200 and the operation part 300, and is drained through the drain hole of the fixing frame 200. In FIG. 15, for convenience' sake, the drain structure of the fixing frame 200 is not illustrated, but is equal to the drain structure illustrated in FIGS. 4 and 6.

As shown in FIG. 15, the fixing frame may be divided into two parts, namely, the fixing frame 200 of the indoor side and the exterior cover shield gasket 500, which is the fixing frame of the outdoor side. The exterior cover shield gasket 500, which is the fixing frame of the outdoor side includes the first elastic part 504 for sealing between the exterior cover shield gasket 500 and the opening part 110 and the second elastic part 506 for sealing between the exterior cover shield gasket 500 and the glass panel 100 to serve as a shield gasket. As described above, if the fixing frame is divided into the two parts, the fixing frame 200 of the indoor side is adhered and fixed to the glass panel by a structural silicone sealant 121 adhered between the outer flange 202 and the glass panel 110. In case that the fixing frame 200 which breaks down is detached to be repaired, only the structural silicone sealant 121 is removed so that the fixing frame 200 can be easily dismantled from the indoor side.

Furthermore, the exterior cover shield gasket 500 may be made with a rubber packing or made of a flexible plastic material. However, if the exterior cover shield gasket 500 is made of a plastic material, preferably, the first elastic part 504 and the second elastic part 506 are attached separately and then are adhered by silicone sealant or a rubber packing material used for the shield gasket. Therefore, it is preferable that the exterior cover shield gasket 500 be formed integrally by a flexible material, such as a rubber material or a silicone sealant material.

Figure 18:
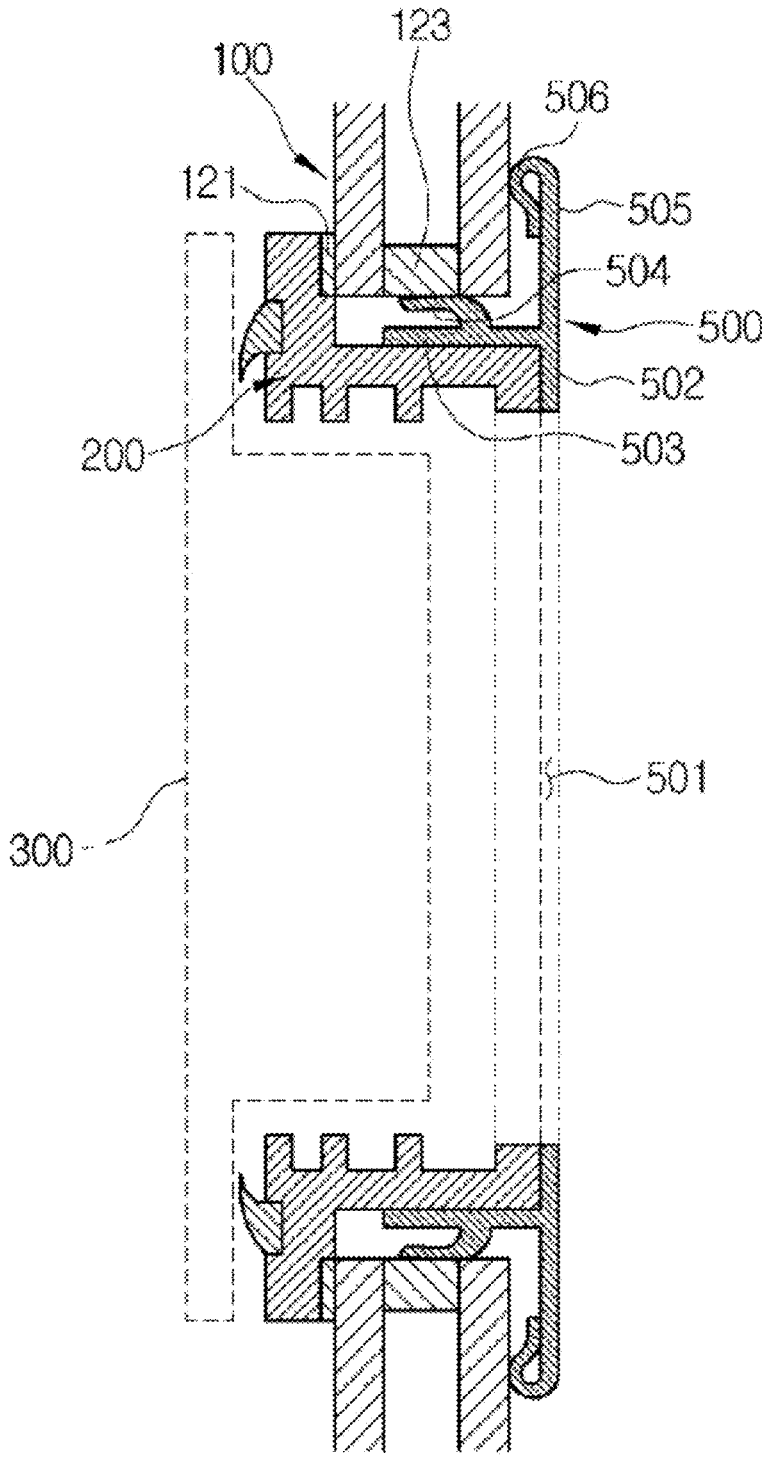
FIG. 18 is a schematic diagram of a structure of an elastic part of the exterior cover shield gasket according to the second preferred embodiment of the present invention.

FIG. 18 is a schematic diagram of another structure of the elastic part of the exterior cover shield gasket according to the second preferred embodiment of the present invention.

In the meantime, as shown in FIG. 15, the first elastic part 504 and the second elastic part 506 may be closed-type elastic parts respectively having empty spaces therein. However, the first elastic part 504 may be a wing-shaped protrusion, and the second elastic part 506 may have a folded rim in a circular arc shape.

Therefore, if the fixing frame has the fixing frame 200 of the indoor side and the exterior cover shield gasket 500, which is the fixing frame of the outdoor side, there is no need to insert and mount another shield gasket, and the structural silicone sealant 121 is removed so that the fixing frame 200 can be easily detached from the indoor side in order to repair the fixing frame 200 which breaks down.

Meanwhile, in case of the indoor ventilation system, the opening part 110 is formed in the window glass 100, the fixing frame 200 is mounted on the opening part 110, and the operation part 300 closes or opens the fixing frame 200 in order to close and open the ventilation window. However, the window glass 100 may be configured as a single tempered glass pane or multiple glass panes to provide thermal insulation effect.

In the case that the window glass is configured as the multiple glass panes, when the opening part 110 is formed, a spacer 230 is inserted between the glass panes in order to maintain an interval between the glass panes and seal a space between the glass panes. If the spacer is an independent part, the number of parts is increased, and installation work becomes cumbersome.

In consideration of the above, in another embodiment, a spacer is formed integrally with the fixing frame.

Figure 19:
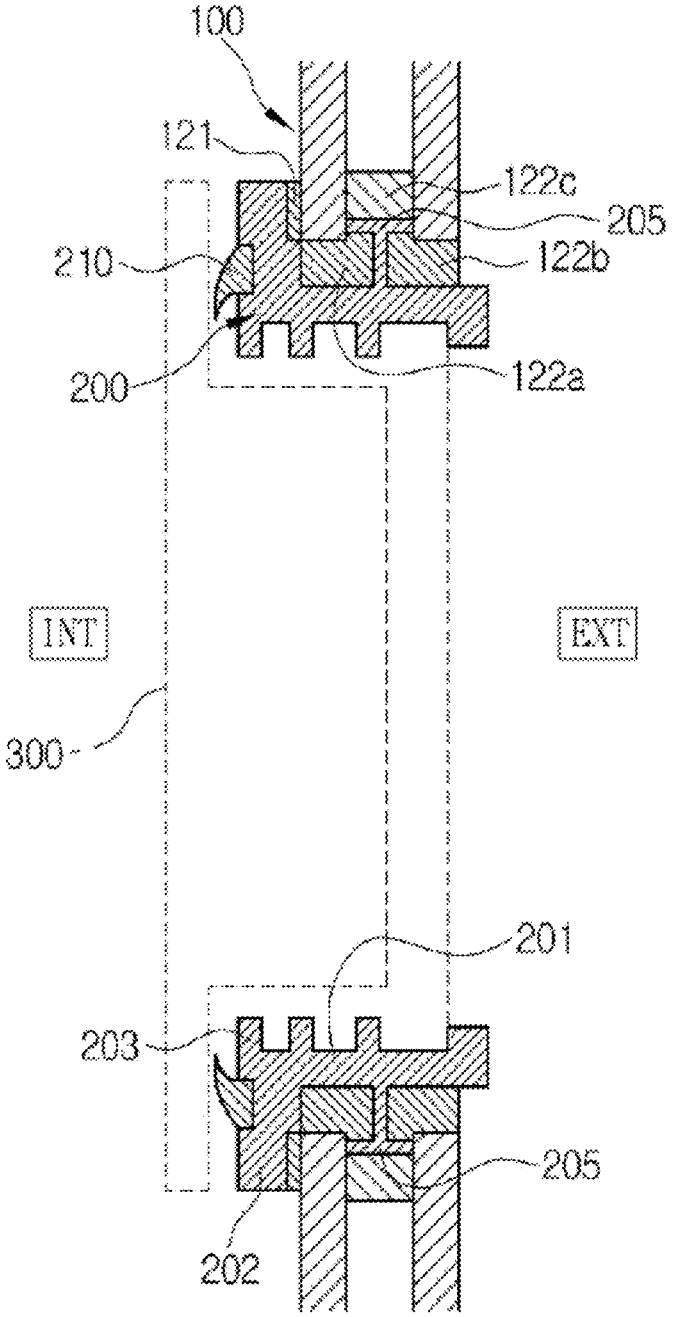
FIG. 19 is a sectional view schematically illustrating the indoor ventilation system having a structure of a spacer-integrated fixing frame according to the present invention.

FIG. 19 is a sectional view schematically illustrating the indoor ventilation system having a structure of a spacer-integrated fixing frame according to the present invention.

The fixing frame 200 includes: a cylindrical part 201 inserted into the opening part 110 and protruding toward outdoor side; an outer flange 202 protruding from the end of the cylindrical part 201 to the outer circumference; and an inner flange 203 protruding toward the inner circumference corresponding to the outer flange 202. As described above, the fixing frame 200 has a ring-shaped spacer 205 protruding from the outer circumference of the cylindrical part 201.

The spacer 205 is to maintain an interval between two glass panes 100, and is formed integrally with the fixing frame 200.

The opening part 110 is formed in the window glass 100. The window glass 100 has two glass panes. If the glass window has three glass panes, two spacers protrude integrally with the fixing frame 200.

In case that the spacer 205 is a fixing frame-integrated spacer, the spacer 205 is arranged between the two glass panes, and a third shield ring 122*c* is inserted into the spacer 205 to seal. First and second shield rings 122*a* and 122*b* are respectively inserted and mounted at the right and left sides of the spacer 205. Moreover, a shield material 121 is inserted and adhered between the outer flange 202 of the fixing frame 200 and the glass panels.

The first to third shield rings 122*a*, 122*b* and 122*c* may be molded in advance. The first and second shield rings 122*a* and 122*b* may be molded in advance and the third shield ring 122*c* may be a shield material made by liquid silicone sealant injected. Alternatively, the first to third shield rings may be all shield material made by liquid silicone sealant injected. Preferably, the shield material 121 and the first to third shield rings 122*a*, 122*b* and 122*c* are all formed by liquid silicone sealant injected.

As described above, in case that the spacer is formed integrally with the fixing frame, the glass window is not installed on site but the glass window having the indoor ventilation system can be manufactured in a factory. Because the spacer is formed integrally with the fixing frame 200, the indoor ventilation system can reduce manufacturing costs since the number of parts is reduced and the manufacturing process is simplified. If the fixing frame is made of a high-strength special material, it can be used semipermanently, and external power applied to the opening part of the glass panel is dispersed to the integrated spacer and the fixing frame so as to improve safety strength.

While the present invention has been particularly shown and described with reference to exemplary embodiments thereof, it will be understood by those of ordinary skill in the art that the particular embodiments do not limit the present invention. It will be also understood by those of ordinary skill in the art that various changes and modifications may be made therein without departing from the technical idea and scope of the present invention and such changes and modifications belong to the claims of the present invention.

The invention claimed is:

1. An indoor ventilation system comprising:

an opening part perforated in a window glass panel; and an opening and closing means having a lid or a cover for blocking or opening the opening part, wherein the opening and closing means further comprises:

a ring-shaped fixing frame sealed to an inner circumference of the opening part; and an operation part disposed to be selectively inserted into the fixing frame to close the ventilation system or to be drawn out of the fixing frame to open the ventilation system, wherein an inner circumferential wall of the fixing frame has a plurality of shielding walls, the inner circumferential wall inclined from an indoor side to an outdoor side, and the plurality of shielding walls has a drain structure, wherein the drain structure is configured to discharge rainwater entering into the fixing frame, and wherein the drain structure comprises:

a drain hole for discharging the rainwater to an outside; and a groove formed in the shielding wall to guide the rainwater to the drain hole.

2. The indoor ventilation system according to claim 1, wherein the opening part is two or more opening parts, the two or more opening parts are formed in the window glass to be spaced apart from each other, and the opening and closing means is two or more opening and closing means, and are respectively mounted in the two or more opening parts to respectively block and open the two or more opening parts.

3. The indoor ventilation system according to claim 1, wherein the fixing frame is embedded in the opening part, the fixing frame includes a cylindrical part and a flange, and an outer circumferential wall of the fixing frame cylindrical part is covered by a shield gasket.

4. The indoor ventilation system according to claim 1, wherein a first ring-shaped gutter is formed near a part of an outer circumferential surface of the fixing frame, and the first ring-shaped gutter collects and discharges rainwater entering through the ventilation system opening part.

5. The indoor ventilation system according to claim 1, wherein the operation part has a hat-shaped structure, and includes:

a cylindrical part having a bottom surface end portion which is blocked; and a flange extending radially from a front end of the indoor side of the cylindrical part.

6. The indoor ventilation system according to claim 1, wherein an outer surface of the operation part has a plurality of shielding walls, the operation part shielding walls comprising at least one guider that prevents the operation part shielding walls from being caught to the fixing frame shielding walls when inserted into the fixing frame.

7. The indoor ventilation system according to claim 1, wherein the fixing frame includes:

a ring-shaped inner flange extending from an inner end portion in a radial direction and at least one insertion groove formed in the ring-shaped inner flange, and wherein the operation part has at least one hook mounted near an edge of the operation part so that the operation part is coupled to the fixing frame when the at least one hook is inserted into the at least one insertion groove.

8. An indoor ventilation system comprising:

an opening part perforated in a window glass panel; and an opening and closing means having a lid or a cover for blocking or opening the opening part, wherein the opening and closing means further comprises:

a fixing frame embedded in the opening part to be sealed to a glass panel of an inner circumference of the opening part; and an operation part disposed to be fixed and combined with the fixing frame or to be drawn out of the fixing frame;

wherein the fixing frame is formed in a ring shape, and the operation part when combined with the lid or cover is inserted into the fixing frame to close a ventilation system and is drawn out of the fixing frame to open the ventilation system;

wherein the fixing frame has a cylindrical structure and has a peripheral outer flange protruding toward an indoor side, and has a gutter part formed on an outer circumferential surface of the cylindrical structure; and wherein the fixing frame has an air filter or a foreign matter filter is mounted within the cylindrical structure adjacent the gutter part in a round partition form; and wherein the ventilation system further comprises a first shield gasket inserted into the opening part to protrude toward an outdoor side, and is inserted between the inner circumference of the opening and the fixing frame to seal.

9. The indoor ventilation system according to claim 8, wherein the window glass is a two-pane window glass with a space therebetween, wherein the opening part includes a spacer inserted and mounted between the two panes to maintain an interval therebetween and to seal the space between the two panes.

10. The indoor ventilation system according to claim 8, further comprising:

a second gutter formed on the peripheral flange of the indoor side of the fixing frame, and a second shield gasket, wherein the second shield gasket includes:

a body part inserted into the second gutter and a wing part protruding from the body part to an outside, and wherein the second shield gasket is compressed into the second gutter by the flange of the operation part to seal a space between the fixing frame and the operation part when the operation part is inserted and mounted into the fixing frame.

11. The indoor ventilation system according to claim 8, wherein the fixing frame further includes an inner flange protruding from the front end of the indoor side and a plurality of insertion grooves formed in the inner flange, and wherein the operation part has a hook-shaped coupling part corresponding to at least one of the plurality of insertion grooves, and the hook-shaped coupling part is inserted into the at least one of the plurality of insertion grooves and is caught to the inner flange by rotation of the operation part, so that the operation part is inserted and caught by the fixing frame.

12. The indoor ventilation system according to claim 8, wherein the fixing frame further comprises:

the gutter part protruding to the outdoor side of the fixing frame so that rainwater gathers and flows down exteriorly;

an inner circumferential surface inclined so that rainwater within the fixing frame flows from the indoor side to the outdoor side, a plurality of shielding walls extend radially from the inner circumferential surface, wherein the plurality of shielding walls located at a bottom surface of the fixing frame have a plurality of grooves, and wherein a drain hole is formed in the fixing frame to discharge the rainwater from the grooves to an outside.

13. An indoor ventilation system, which includes an opening part perforated in a window glass panel, a ring-shaped fixing frame including a cylindrical part and an outer flange, the fixing frame inserted into the opening part to protrude to an outdoor side, and an operation part for blocking or opening the fixing frame, the indoor ventilation system further comprising:

a first shield gasket to be interposed between the opening part and the fixing frame, wherein, in the undeformed state, the first shield gasket is formed in a doughnut shape, and includes:

a through hole part formed at a center of the first shield gasket;

a body part extending radially from the through hole part and having a predetermined radial dimension corresponding to a thickness of the window glass panel; and an adhesive surface part extending radially from the body part, and wherein when the adhesive surface part is adhered on the window glass panel around the opening part and the fixing frame is forcibly inserted into the through hole part and the opening part, the body part is transformed from the doughnut shape into a cylindrical shape and is interposed between the opening part and an outer circumference of the cylindrical part of the fixing frame to seal a space between the window glass opening part and the fixing frame.

14. The indoor ventilation system according to claim 13, wherein the first shield gasket further includes an elastic protrusion formed on an inner circumference adjacent the through hole part, the elastic protrusion has a compressible space part formed therein, such that when the first shield gasket is interposed between an outdoor side of the window glass panel at the opening part and the outer circumference of the cylindrical part of the fixing frame, the elastic protrusion is compressed.

15. The indoor ventilation system according to claim 13, the fixing frame further comprising:

a plurality of pivoting hooks mounted through a plurality of holes in the cylindrical part of the fixing frame, and protruding to the outdoor side in order to elastically support the fixing frame to an outdoor side of the window glass panel at the opening part.

16. An indoor ventilation system, which includes an opening part perforated in a window glass panel, a ring-shaped fixing frame comprising a cylindrical part and inserted into the opening part, an operation part for selectively blocking or opening the fixing frame, and an exterior cover shield gasket, the indoor ventilation system further comprising:

the exterior cover shield gasket inserted into the opening part from an outdoor side, the fixing frame inserted into the opening part from an indoor side such that the exterior cover shield gasket covers the outdoor side of the fixing frame; and wherein the exterior cover shield gasket includes:

a through hole formed in a middle thereof;

a front rim cover part extending radially inward from an inner circumference of the through hole to cover a front end portion of the fixing frame at the outdoor side;

a cylindrical shield gasket protruding axially from an outer face of the front rim cover part and sealingly interposed between an outer circumference of the fixing frame cylindrical part and the inner circumference of the opening part; and an exterior cover part extending outwardly from the front rim cover part to cover an outdoor part of the window glass panel at the opening part.

17. The indoor ventilation system according to claim 16, wherein the cylindrical shield gasket further includes:

a first elastic part protruding from an outer circumference of the cylindrical shield gasket, and forming an inner space part therebetween, such that when the first elastic part is compressed between the opening part in the window glass panel and the fixing frame cylindrical part, the exterior cover part is pressed to the window glass panel around the opening part with elasticity, and a second elastic part, which extends from the exterior cover part, forming an inner space part between the exterior cover part and the window glass panel to elastically seal the exterior cover part around the opening part.

* * * * *